US010041701B1

(12) United States Patent
Koplow et al.

(10) Patent No.: US 10,041,701 B1
(45) **Date of Patent: *Aug. 7, 2018**

(54) HEATING AND COOLING DEVICES, SYSTEMS AND RELATED METHOD

(71) Applicant: National Technology & Engineering Solutions of Sandia, LLC, Albuquerque, NM (US)

(72) Inventors: Jeffrey P. Koplow, San Ramon, CA (US); Harumichi Arthur Kariya, Bellflower, CA (US); Wayne Lawrence Staats, Jr., Livermore, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 593 days.

This patent is subject to a terminal disclaimer.

(21) Appl. No.: 14/487,540

(22) Filed: Sep. 16, 2014

Related U.S. Application Data

(60) Provisional application No. 61/881,853, filed on Sep. 24, 2013.

(51) Int. Cl.

| | |
|---|---|
| ***F25B 1/00*** | (2006.01) |
| ***F25B 41/04*** | (2006.01) |
| ***F25B 3/00*** | (2006.01) |

(52) U.S. Cl.
CPC ..... *F25B 1/005* (2013.01); *F25B 3/00* (2013.01); *F25B 41/043* (2013.01)

(58) Field of Classification Search
CPC ..... F25B 3/00; F25B 1/005; F25B 41/043
See application file for complete search history.

(56) References Cited

U.S. PATENT DOCUMENTS

| | | | | | |
|---|---|---|---|---|---|
| 3,347,059 | A * | 10/1967 | Laing | F25B 3/00 | 165/92 |
| 3,696,634 | A * | 10/1972 | Ludin | F25B 3/00 | 165/104.28 |
| 4,000,778 | A * | 1/1977 | Laing | F25B 3/00 | 165/104.31 |
| 4,073,338 | A * | 2/1978 | Fujikake | F28D 11/02 | 165/86 |
| 4,207,748 | A * | 6/1980 | Nebgen | F25B 3/00 | 62/115 |
| 5,954,478 | A | 9/1999 | Stickler et al. | | |
| 8,228,675 | B2 | 7/2012 | Koplow | | |

* cited by examiner

*Primary Examiner* — Orlando E Aviles Bosques
(74) *Attorney, Agent, or Firm* — Madelynne J. Farber

(57) ABSTRACT

Embodiments disclosed herein relate to devices, systems, and methods for cooling and/or heating a medium as well as cooling and/or heating an environment containing the medium. More specifically, at least one embodiment includes a heat pump that may heat and/or cool a medium and, in some instances, may transfer heat from one location to another location.

24 Claims, 19 Drawing Sheets

HEATING AND COOLING DEVICES, SYSTEMS AND RELATED METHOD

CROSS-REFERENCE TO RELATED APPLICATIONS

This application claims priority to U.S. Provisional Application No. 61/881,853 filed on 24 Sep. 2013, the disclosure of which is incorporated herein, in its entirety, by this reference.

STATEMENT REGARDING GOVERNMENT RESEARCH AND DEVELOPMENT

This invention was made with Government support under government contract no. DE-AC04-94AL85000 awarded by U.S. Department of Energy to Sandia Corporation. The Government has certain rights in the invention, including a paid-up license and the right, in limited circumstances, to require the owner of any patent issuing in this invention to license others on reasonable terms.

BACKGROUND

Various commercial applications may require conditioning a medium, such as fluid in an environment. For example, occupants of a building may have a preferred air temperature range for their environment. Thus, controlling air temperature in the building or a portion of the building may provide a comfortable environment for the occupants. Moreover, controlling the medium temperature in an environment may be necessary or preferable for sustaining life and/or preventing damage to property. For instance, a preferred temperature range may be required for vitality of fish and other living organisms. Similarly, maintaining a particular temperature range in an environment may sustain and promote growth of plants. In addition, maintaining a temperature range in an environment may avoid damaging equipment (e.g., avoid freezing of fluid in lines, overheating, etc.) and other property.

Therefore, manufacturers and users of medium conditioning systems continue to seek systems with improved useful life, operating efficiency, low noise, and/or other advantages.

SUMMARY

Embodiments disclosed herein relate to devices, systems, and methods for cooling and/or heating a medium as well as cooling and/or heating an environment containing the medium. More specifically, at least one embodiment includes a heat pump that may heat and/or cool a medium and, in some instances, may transfer heat from one location to another location. For example, the heat pump may remove heat from a first location (e.g., interior of a building) to a second location (e.g., exterior of the building), thereby reducing the temperature of the medium at the first location. Alternatively or additionally, the heat pump may heat the medium at the first location.

At least one embodiment includes a heat pump. For example, the heat pump includes a compressor configured to compress a refrigerant and a hot-side heat exchanger operably connected to the compressor. The hot-side heat exchanger is configured to receive the compressed refrigerant from the compressor. At least one expansion valve or other pressure-reduction device is configured to receive the compressed refrigerant from the hot-side heat exchanger and reduce the refrigerant pressure. The heat pump also includes a cold-side heat exchanger operably connected to the expansion valve and configured to receive the refrigerant therefrom. Additionally, one or more of the hot-side heat exchanger or the cold-side heat exchanger is rotatable.

Embodiments also include a method of operating a heat pump. The method includes compressing a refrigerant and distributing the compressed refrigerant into a hot-side heat exchanger. The method further includes rotating the hot-side heat exchanger together with at least some of the compressed refrigerant, thereby condensing the compressed refrigerant to a liquid-phase.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
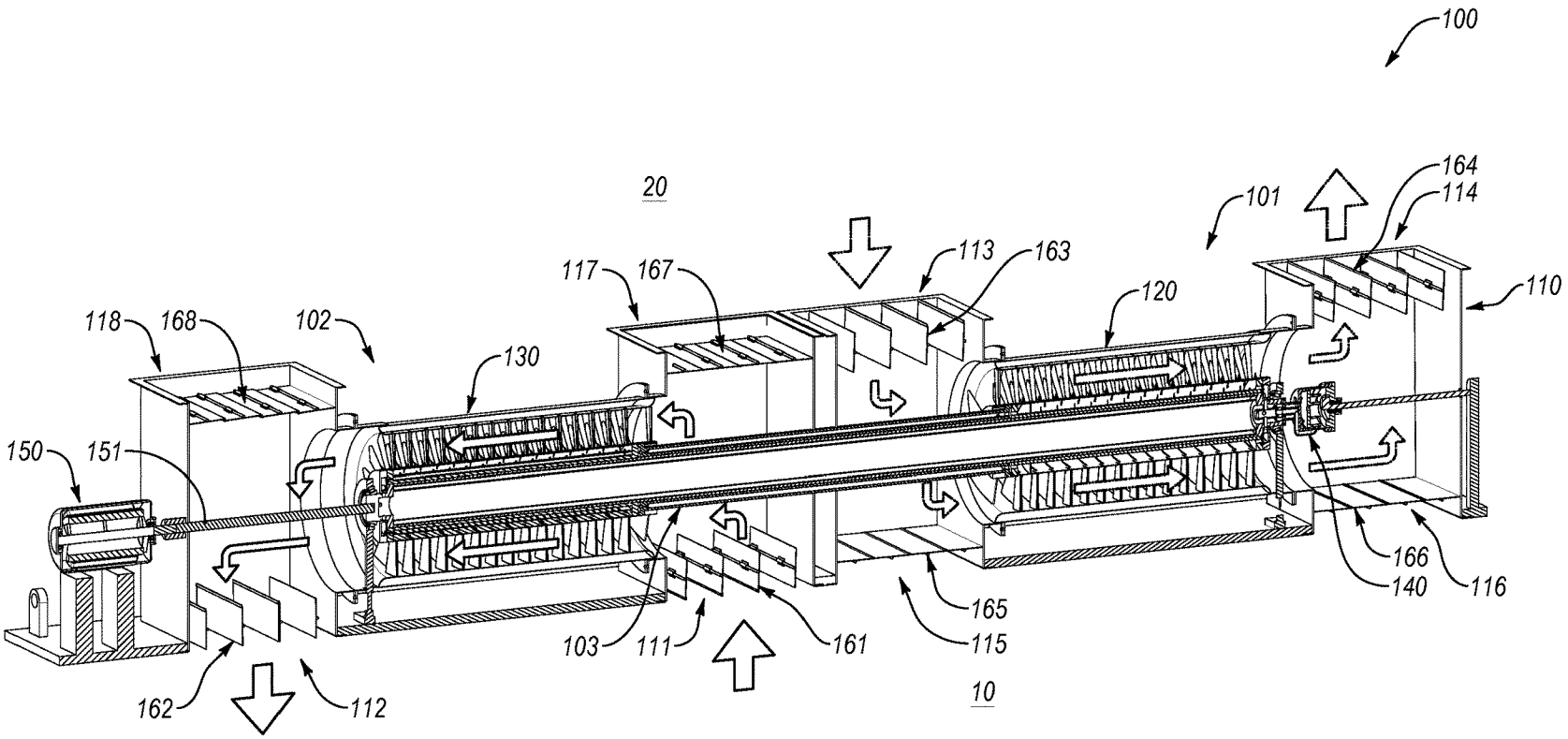
FIG. 1A is an isometric, cross-sectional view of a heat pump and a ductwork connected thereto according to an embodiment.

Embodiments disclosed herein relate to devices, systems, and methods for cooling and/or heating a medium as well as cooling and/or heating an environment containing the medium. More specifically, at least one embodiment includes a heat pump that may heat and/or cool a medium and, in some instances, may transfer heat from one location to another location. For example, the heat pump may remove heat from a first location (e.g., interior of a building) to a second location (e.g., exterior of the building), thereby reducing the temperature of the medium at the first location. Alternatively or additionally, the heat pump may heat the medium at the first location.

In some embodiments, the heat pump may include a hot-side and a cold-side and two respective hot-side and cold-side heat exchangers, which may allow a medium to pass therethrough during operation of the heat pump. Hence, in some instances, a cold-side medium passing through the cold-side heat exchanger may be cooled and hot-side medium passing through the hot-side heat exchanger may be heated. Generally, the heat pump may operate substantially continuously and may, for example, substantially continuously cool or heat medium inside a chamber (e.g., a building) to a suitable or desired temperature.

In an embodiment, cold-side and/or hot-side heat exchangers may be rotatable. For instance, the cold-side and/or hot-side heat exchangers may include one or more rotatable blades, which may have a refrigerant therein (e.g., the blades of the heat exchanger may be hollow and/or may include one or more channels for the refrigerant to flow therein, as described below). Accordingly, the cold-side and/or hot-side medium may exchange heat with blades as the cold-side and the hot-side media pass across or otherwise in contact with the blades. Under some operating conditions, rotation of the cold-side and/or hot-side heat exchangers and corresponding blades thereof may reduce the boundary layer at surfaces of the blades of the hot-side and/or cold-side heat exchangers, which may reduce thermal resistance (as compared with an un-reduced boundary layer). Reduction of thermal resistance of the blades may be facilitated by including blades with high aspect ratio.

Furthermore, rotation of the cold-side and/or hot-side heat exchangers may reduce fouling and/or clogging thereof, which may facilitate extended operation at an intended or suitable heat-exchange efficiency (as compared with stationary blades of a heat exchanger). Also, in some instances, rotation of the cold-side heat exchanger also may decrease or eliminate reduction in heat transfer between the blades of the cold-side heat exchanger and the cold-side medium that may otherwise result from condensate settling on the blades of the cold-side heat exchanger and/or freezing or frosting of the blades from the condensate. For example, rotation of the blades of the cold-side heat exchanger may expel or otherwise discharge the condensate therefrom. In other words, the centrifugal force due to the rotation, may prevent dust, condensate and other debris from attaching to the heat transfer surfaces of the heat exchangers.

Moreover, under some operating conditions, rotating the cold-side and/or hot-side heat exchanger directly produces relative motion between such heat exchanger (e.g., blades of the heat exchanger) and the surrounding media, which may produce an increase in relative velocity therebetween (as compared with forcing media through a stationary heat exchanger by a blower). In other words, to produce the relative speed between the media forced by the blower and the heat exchanger equal to the speed of the rotating heat exchanger, the blower would require a higher rotational speed than the rotating heat exchanger.

In at least one embodiment, the cold-side and hot-side heat exchangers may be rotated together or substantially simultaneously (e.g., at the same speed or at different speeds). For example, a single motor may rotate both the cold-side and the hot-side heat exchangers. Alternatively, a first motor may rotate the cold-side heat exchanger and a second motor may rotate the hot-side heat exchanger. Moreover, in some instances, the blades of the cold-side heat exchanger may advance the cold-side medium therethrough. Similarly, the hot-side heat exchanger may advance the hot-side medium therethrough.

In an embodiment, as described below in more detail, the heat pump may include a compressor, which may compress and/or pressurize a refrigerant in the heat pump. In some configurations, at least a portion of the compressor may rotate together with the hot-side heat exchanger and/or cold-side heat exchanger. Under some operating conditions, the hot-side heat exchanger, the cold-side heat exchanger, and at least a portion of the compressor may rotate together in a manner that facilitates cooling of the cold-side medium and/or heating of the hot-side medium.

For example, the compressor may compress the refrigerant, and the compressed refrigerant may flow from the hot side of the heat pump toward and/or into the cold side of the heat pump. For instance, the compressed refrigerant may be cooled and at least partially condensed at the hot-side heat exchanger and may flow from the hot-side heat exchanger to the cold-side heat exchanger. Specifically, in at least some embodiments, the compressed and condensed refrigerant may expand prior to the cold-side heat exchanger, thereby cooling at least a portion of the cold-side heat exchanger. As the cold-side medium passes through the cold-side heat exchanger, heat from the cold-side medium may be transferred to the cold-side heat exchanger and to the refrigerant therein (i.e., the temperature of the cold-side medium may be lowered as the cold-side medium passes through the cold-side heat exchanger).

Conventional heat pumps typically include a section that superheats the vapor prior to entry into the compressor (i.e., temperature above the vaporization temperature of the refrigerant) to assure that liquid refrigerant does not enter the compressor, which may reduce coefficient of performance. Preventing liquid refrigerant from entering the compressor may increase the useful life thereof. In some embodiments, heat exchangers of the heat pumps described herein may separate the liquid-phase and gas-phase refrigerant, thereby minimizing or eliminating the requirement of superheating of the refrigerant vapor, while channeling the gas-phase refrigerant (i.e., vaporized refrigerant) to the compressor. For example, superheating may be reduced by ensuring that only gas-phase refrigerant exits the cold-side heat exchanger.

Additionally, in some instances, separation of the liquid-phase and gas-phase refrigerant may produce a favorable pressure drop and/or increase heat transfer to the refrigerant. For instance, phase separation may prevent the development and rupture of vapor bubbles and ejection of liquid into surrounding flow of gas-phase refrigerant during phase change from liquid to vapor. Hence, in some examples, such phase-separated, stratified flow may decrease pressure drop in the flow and increase local heat transfer between the refrigerant and media surrounding the heat exchanger. In an embodiment, the heat pump may include microstructures or nanostructures inside channels carrying the refrigerant; such structures may facilitate phase separation and further evaporation at channel surface. For examples, such structures may spread a film of liquid-phase refrigerant on inner surface of channel(s) that carry the refrigerant, such that the larger surface of the liquid-phase refrigerant is in contact with the channel and is exposed to heat transfer with surrounding media.

It should be appreciated that various embodiments described herein are not limited to heat pumps utilizing vapor-compression refrigeration cycle. Other embodiments may include vapor absorption cycles and single-phase gas cycles (e.g., reverse Brayton cycle, Sirling heat pump, etc.). Furthermore, the mechanisms of heat exchange and fluid flow characteristics in rotation described herein may be used in other thermal systems that require the transfer of heat between two or more thermal reservoirs. Such embodiments may include phase-change cycles (e.g., Rankine cycle), single-phase cycles (e.g., Brayton cycle, Stirling cycle, Ericsson cycle, Carnot cycle) and electron cycles (e.g., thermoelectric cycles for extraction of useful work therefrom). For consistency in description, the following descriptions will focus on heat pump embodiments utilizing vapor-compression cycles.

Figure 1B:
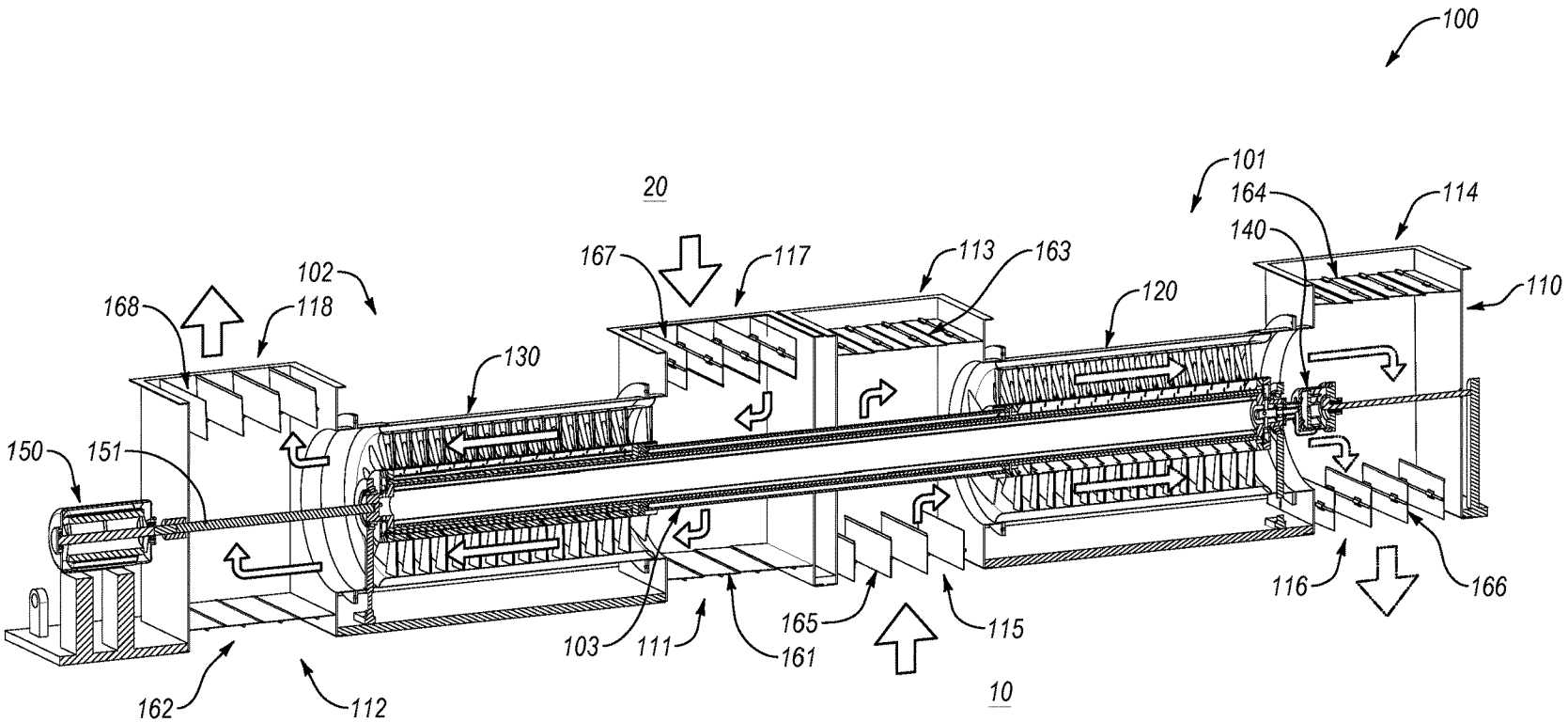
FIG. 1B is an isometric, cutaway view of a heat pump and a ductwork connected thereto according to another embodiment.

FIGS. 1A-1B show a heat pump 100 according to one or more embodiments. Generally, it should be appreciated that the heat pump 100 may be any suitable size and may be scaled to cool or heat a chamber of any suitable size (e.g., room, building, etc.). More specifically, FIG. 1A shows the heat pump 100 and connected ductwork 110 configured to cool air inside a structure or a chamber 10 (e.g., inside a building), and FIG. 1B shows the heat pump 100 and the connected ductwork 110 configured to heat the air inside the chamber 10. As described above, the heat pump 100 may cool and/or heat any suitable medium (e.g., gas, liquid, semi-liquid, etc.). However, for ease of description, at least some of the references herein are made to "air"; it should be appreciated that this is not intended to be limiting with respect to the medium that may be cooled and/or heated by the heat pump.

Generally, the heat pump 100 may include a hot side 101 and a cold side 102. The hot side 101 may be a condenser side, which may include a compressed refrigerant, and the cold side 102 may be an evaporator side, which may include expanded and/or evaporated refrigerant. Furthermore, the refrigerant may be transferred or distributed from the hot side 101 to the cold side 102 (e.g., the refrigerant may expand before and/or during distribution from the hot side 101 to the cold side 102).

In an embodiment, the heat pump 100 may include a hot-side heat exchanger 120 at the hot side 101 and a cold-side heat exchanger 130 at the cold side 102. As such, for example, the heat pump 100 may pass a cold-side medium (e.g., air from the chamber 10 (as shown in FIG. 1A)) through the cold-side heat exchanger 130, thereby cooling the cold-side medium. Analogously, the heat pump 100 may pass hot-side medium (e.g., ambient air outside of the chamber 10 (as shown in FIG. 1A); air from the chamber 10 (as shown in FIG. 1B)) through the hot-side heat exchanger 120, thereby heating the hot-side medium.

In an embodiment, as shown in FIG. 1A, air from the chamber 10 may enter the cold-side heat exchanger 130 through a cold-side chamber intake 111 of the ductwork 110. As mentioned above, the cold-side heat exchanger 130 may cool the air, as the air passes therethrough. As the cooled air exits the cold-side heat exchanger 130, the ductwork 110 may direct the cooled air back into the chamber 10. For instance, the connected ductwork 110 may include a cold-side supply-side outlet 112 that may be operably connected to and/or in fluid communication with the chamber 10. Hence, the cooled air that exits the cold-side heat exchanger 130 may enter the chamber 10 through the cold-side supply-side outlet 112.

In some embodiments, the refrigerant may be compressed in the hot side 101 of the heat pump 100. For example, a compressor 140 may compress the refrigerant. Also, the compressed refrigerant may be distributed or circulated into the hot-side heat exchanger 120. Moreover, the compressed refrigerant may be cooled and/or may condense in the hot-side heat exchanger 120 by releasing heat to the hot-side medium. The hot-side medium may therefore increase in temperature as it passes through the hot-side heat exchanger.

In one embodiment, as shown in FIG. 1A, ambient air from the ambient environment 20 may enter the hot-side heat exchanger 120 through a hot-side ambient intake 113 of the ductwork 110. As the ambient air passes through the hot-side heat exchanger 120, the ambient air may cool the compressed refrigerant in the hot-side heat exchanger 120. After passing through the hot-side heat exchanger 120, in one or more embodiments, the ambient air may exit back into the ambient environment 20 through a hot-side ambient outlet 114. Hence, for instance, circulating ambient air (or other suitable medium) through the hot-side heat exchanger 120 may continuously cool the compressed refrigerant therein.

Moreover, cooled and compressed and/or condensed refrigerant may be distributed to and expanded prior to entering the cold-side heat exchanger 130, thereby resulting in a lower temperature at the cold-side heat exchanger 130 than at the hot-side heat exchanger 120. The expanded refrigerant in the cold-side heat exchanger 130 may evaporate and/or be may be heated through heat gain from the cold-side medium. Consequently, the medium exiting the cold-side heat exchanger 120 may have a lower temperature than the medium entering the cold-side heat exchanger 120. Circulating the air exiting the hot-side heat exchanger 120 back into the chamber 10 as shown in FIG. 1A may cool air therein (i.e., the temperature in the chamber may be reduced).

In some embodiments, the hot-side heat exchanger 120 and/or cold-side heat exchanger 130 may rotate about one or more rotation axes. For instance, the hot-side heat exchanger 120 and cold-side heat exchanger 130 may rotate about a single rotation axis. In an example, the heat pump 100 may include a motor 150 (e.g., an electric AC or DC motor) that may rotate the hot-side heat exchanger 120 and cold-side heat exchanger 130 about the rotation axis during operation of the heat pump 100. In some examples, the motor 150 may be mounted on or otherwise secured to a motor mount (e.g., the motor mount may remain stationary relative to the housing of the motor 150).

It should be appreciated that the heat pump 100 may include any suitable number of motors that may be arranged in any number of suitable configurations to rotate the hot-side heat exchanger 120 and/or cold-side heat exchanger 130. In an embodiment, a drive shaft 151 may connect the motor 150 to the hot-side heat exchanger 120 and/or cold-side heat exchanger 130. For example, the drive shaft 151 may be connected to the motor 150 or may be integrated therewith. Similarly, the drive shaft 151 may be connected to the hot-side heat exchanger 120 and/or cold-side heat exchanger 130 or may be integrated therewith. In any event, the drive shaft 151 may transfer rotation from the motor 150 to the hot-side heat exchanger 120 and/or cold-side heat exchanger 130. In other embodiments, other power transmission methods, such as gears, pulleys, non-direct couplings (e.g. magnetic coupling) or any combination thereof may be utilized to impart rotation.

In at least one embodiment, the hot-side heat exchanger 120 and cold-side heat exchanger 130 may be connected together by a connecting shaft or connecting conduit 103. In some examples, as described below in more detail, the connecting conduit 103 may include one or more channels for the refrigerant to flow from the hot-side heat exchanger 120 toward the cold-side heat exchanger 130. Additionally or alternatively, the connecting conduit 103 may include one or more channels for the refrigerant to flow toward and/or into the compressor 140. As such, for example, the hot-side heat exchanger 120, cold-side heat exchanger 130, compressor 140, expansion valve 240 (FIG. 2D), and connecting conduit 103 may collectively complete or implement a refrigeration cycle, where the refrigerant may be compressed by the compressor 140; then, the compressed refrigerant may be cooled and condensed in the hot-side heat exchanger 120 and may flow into the cold-side heat exchanger 130 across the connecting conduit 103. The condensed refrigerant may expand across an expansion valve 240, which may be located at the exit of the hot-side heat exchanger, in the conduit (as shown in FIG. 2D), or in the cold-side heat exchanger and evaporate in the cold-side heat exchanger 130 and may, subsequently, return across the connecting conduit 103 into the compressor 140. It should be appreciated that, in at least one embodiment (FIGS. 9B and 10A), the hot-side heat exchanger 120 and cold-side heat exchanger 130 may be connected directly to each other, without the connecting conduit 103 intervening therebetween. Likewise, the connecting conduit 103 may have any suitable length.

In some embodiments, the heat pump 100 may heat the chamber medium. For example, as shown in FIG. 1B, the medium that is intended to be heated, such as the air from the chamber 10, may pass through the hot-side heat exchanger 120 of the heat pump 100. More specifically, according to at least one embodiment, air from the chamber 10 may enter the hot-side heat exchanger 120 through a hot-side chamber intake 115 and may pass through the hot-side heat exchanger 120. As the air passes through the hot-side heat exchanger 120, the heat from the hot-side heat exchanger 120 may be transferred to the air (i.e., the heat from the compressed refrigerant may be transferred to through the hot-side heat exchanger 120 to the air passing through the hot-side heat exchanger 120).

After exiting the hot-side heat exchanger 120, the air may be directed back into the chamber 10. In an embodiment, the ductwork 110 may include hot-side supply outlet 116, and the air flowing out of the hot-side heat exchanger 120 may enter the chamber 10 through the hot-side supply outlet 116. Hence, for instance, the air in the chamber 10 may be heated by circulating the air from the chamber 10, through the hot-side heat exchanger 120.

In an embodiment, the refrigerant may be heated in the cold-side heat exchanger 130 by passing a medium therethrough. For instance, under some operating conditions, ambient air in the ambient environment 20 may have a higher temperature than the expanded refrigerant in the cold-side heat exchanger 130. Accordingly, passing ambient air through the cold-side heat exchanger 130 may heat and/or evaporate the expanded refrigerant therein (i.e., the cold-side heat exchanger 130 may transfer heat from the ambient air to the refrigerant). In at least one example, the ambient air may enter the cold-side heat exchanger 130 through a cold-side ambient intake 117 of the connected ductwork 110 and may be directed toward and into the cold-side heat exchanger 130. After passing through the cold-side heat exchanger 130, the air may be directed back out to the ambient environment 20 through the cold-side ambient outlet 118.

Furthermore, in some embodiments, the connected ductwork 110 may include valves, dampers, louvers, similar mechanisms, or combinations thereof that may reconfigure the heat pump 100 from cooling the air in the chamber 10 (e.g., FIG. 1A) to heating the air in the chamber 10 (e.g., FIG. 1B). In particular, for instance, as shown in FIG. 1B, louvers 165, 166 may be open in a manner that allows the air in the chamber 10 to enter the hot-side chamber intake 115 and exit out of the hot-side supply outlet 116. In such a configuration, the air form the chamber 10 may enter the hot-side heat exchanger 120 from the hot-side chamber intake 115 and exit out of the hot-side supply outlet 116 back into the chamber 10 after being conditioned or heated by the hot-side heat exchanger 120. In addition, the louvers 163, 164 may close the respective hot-side ambient intake 113 and hot-side ambient outlet 114.

Additionally or alternatively, louvers 161, 162 may close the cold-side chamber intake 111 and the cold-side supply-side outlet 112 of the ductwork 110, such that the air from the chamber 10 is prevented from entering the cold-side heat exchanger 130. In an embodiment, however, louver 167 may be open in a manner that allows the ambient air from the ambient environment 20 to flow through the cold-side ambient intake 117 and into the cold-side heat exchanger 130. Furthermore, louver 168 also may be opened in a manner that allows the air exiting the cold-side heat exchanger 130 flow into the ambient environment 20 through the cold-side ambient outlet 118.

Conversely, as shown in FIG. 1A, the louvers 161, 162 may be opened in a manner that allow the air from the chamber 10 to enter and pass through the cold-side heat exchanger 130 and back into the chamber 10. Moreover, in some examples, the louvers 167, 168 may prevent ambient air from entering the cold-side heat exchanger 130. In any event, the louvers of the heat pump 100 may be operated in a manner that allows the air from the chamber 10 to pass through the cold-side heat exchanger 130 and exit back into the chamber 10 (i.e., thereby cooling the air in the chamber), while preventing the ambient air from entering the cold-side heat exchanger 130.

In an embodiment, the louvers 165, 166 may be closed, thereby preventing the air in the chamber 10 from entering the hot-side heat exchanger 120. In some instances, however, the louvers 163, 164 may be open to allow the ambient air to enter and pass through the hot-side heat exchanger 120, in a manner described above. In any case, the heat pump 100 may include any suitable number of louvers, such as louvers 161, 162, 163, 164, 165, 166, 167, 168, which may be operated to reconfigure the conditioning of the air (or other media; e.g. air in the chamber 10). Specifically, the heat pump 100 may be configured to heat or to cool the air in the chamber 10 be opening and/or closing suitable louvers (e.g., as described above).

Figure 2A:
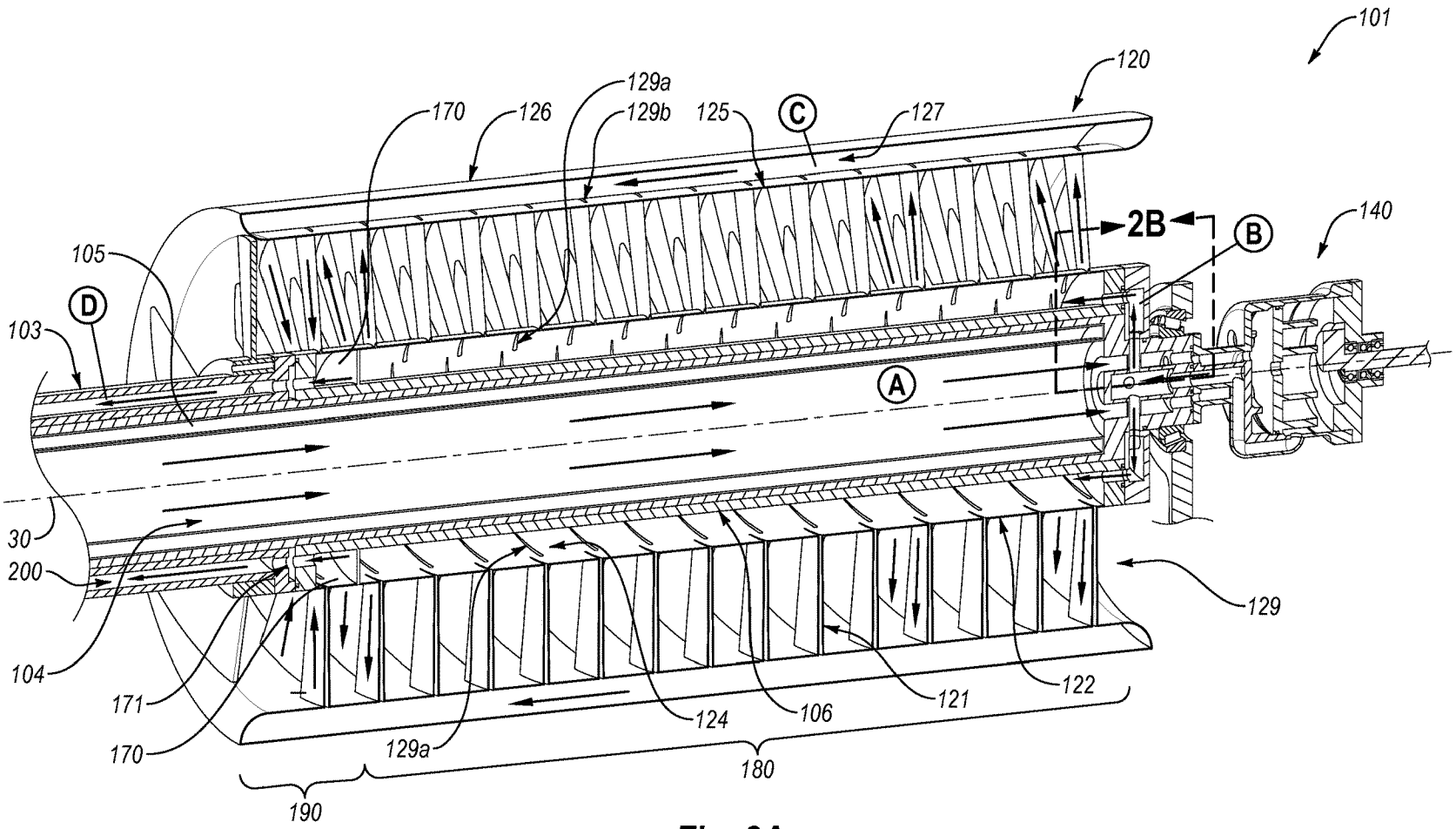
FIG. 2A is an isometric, cutaway view of a hot-side heat exchanger according to an embodiment.

FIG. 2A illustrates the hot side 101 of the heat pump according to at least one embodiment. For instance, the hot side 101 may include the hot-side heat exchanger 120 that has multiple blades 121 attached to an inner condenser shell 122. For example, the inner condenser shell 122 may be approximately cylindrical or have a shape of a hollow cylinder. It should be appreciated, however, that the inner condenser shell 122 may have any other suitable shape.

In an embodiment, the blades 121 and the inner condenser shell 122 may rotate together about the rotation axis 30. The connecting conduit 103 also may include a core shaft 106 (e.g., the core shaft 106 may provide structural connection between the hot-side heat exchanger 120 and the cold-side heat exchanger 130 (FIGS. 1A-1B). Moreover, in some instances, the inner condenser shell 122 may be attached or connected to the core shaft 106. For example, the inner condenser shell 122 together with the blades 121 may be attached or connected to the core shaft 106 (e.g., the blades 121 may be attached or connected to the inner condenser shell 122 and the inner condenser shell 122 may be attached or connected to the core shaft 106). As such, for instance, rotation of the connecting conduit 103 may produce corresponding rotation of the inner condenser shell 122 and blades 121.

In an embodiment, as shown in FIG. 2A, the hot-side heat exchanger 120 may include a compressed refrigerant channel 124. For example, the core shaft 106 and the inner condenser shell 122 may form the compressed refrigerant channel 124 therebetween (e.g., the compressed refrigerant channel 124 may be approximately cylindrical and/or may wrap about the core shaft 106 and may be enclosed by the inner condenser shell 122). As described below in more detail, the compressed refrigerant may flow into and along the compressed refrigerant channel 124 (e.g., in a direction toward the cold-side heat exchanger) and into the blades 121 of the hot-side heat exchanger 120. Hence, in some embodiments, the compressed refrigerant may be cooled and/or condensed in the blades 121, and the compressed, cooled and/or condensed refrigerant may flow into and along a condensed refrigerant channel 127 (e.g., toward the cold-side heat exchanger). In additional or alternative embodiments, the cold-side and/or hot-side heat exchangers (e.g., condenser shell, connecting conduit, etc.) may include one or more shelves, as more fully described in U.S. Pat. No. 5,954,478, entitled "Evaporatively Cooled Rotor For A Gas Turbine Engine," which is incorporated herein in its entirety by this reference. For instance, such shelves may facilitate flow of refrigerant and heat exchange between the refrigerant and the media passing through the corresponding cold-side heat exchanger and/or hot-side heat exchanger.

Generally, the pressure generated by the compressor 140 drives or forces the refrigerant along the hot-side heat exchanger 120 and toward the cold side of the heat pump (e.g., toward the cold-side heat exchanger) as indicated by the arrows. Furthermore, as described below in more detail, in some embodiments, the compressed refrigerant may be in the gas phase. As the compressed refrigerant is cooled in the blades 121, at least some of the refrigerant may condense to a liquid phase. Also, in an embodiment, the condensed refrigerant channel 127 may be radially spaced apart from the rotation axis 30 (e.g., by the blades). Moreover, in some instances, the condensed refrigerant channel 127 may be radially spaced apart from the compressed refrigerant channel 124 (i.e., the blades 121 may space the condensed refrigerant channel 127 from the compressed refrigerant channel 124). In any case, under at least some operating conditions, as the hot-side heat exchanger 120 rotates about the rotation axis 30, centrifugal forces may separate the liquid or condensed refrigerant from the refrigerant in the gas phase and may force the condensed refrigerant away from the rotation axis 30 and into the condensed refrigerant channel 127 of the hot-side heat exchanger 120 (as described below in more detail).

Furthermore, the hot-side heat exchanger 120 may include a blade casing 125 and an outer shell 126 (e.g., the outer shell 126 may define the exterior of the hot-side heat exchanger 120). For example, the condensed refrigerant channel 127 may be formed by and between the blade casing 125 and outer shell 126 (e.g., the condensed refrigerant channel 127 may be approximately cylindrical and/or may wrap around the blade casing 125 and may be enclosed by and between the outer shell 126 and the blade casing 125). In at least one embodiment, the blade casing 125 may be approximately cylindrical. Similarly, the outer shell 126 may be approximately cylindrical. For example, the blades 121 may extend between the inner shell 122 and blade casing 125 (e.g., the blade casing 125 may be secured to the core shaft 106 by the blades 121). Hence, for instance, the blades 121, the inner shell 122, and blade casing 125 may rotate together with the connecting conduit 103.

Also, the outer shell 126 may be attached or connected to the blade casing 125. For example, a portion of the outer shell 126 may be folded or turned toward the blade casing 125 and/or a portion of the blade casing 125 may be folded or turned toward the outer shell 126 and may connect together. In any event, in some embodiments, the blade casing 125 may be attached to the outer shell 126. As such, for instance, the outer shell 126 may rotate together with the blades 121 about the rotation axis 30.

Figure 2B:
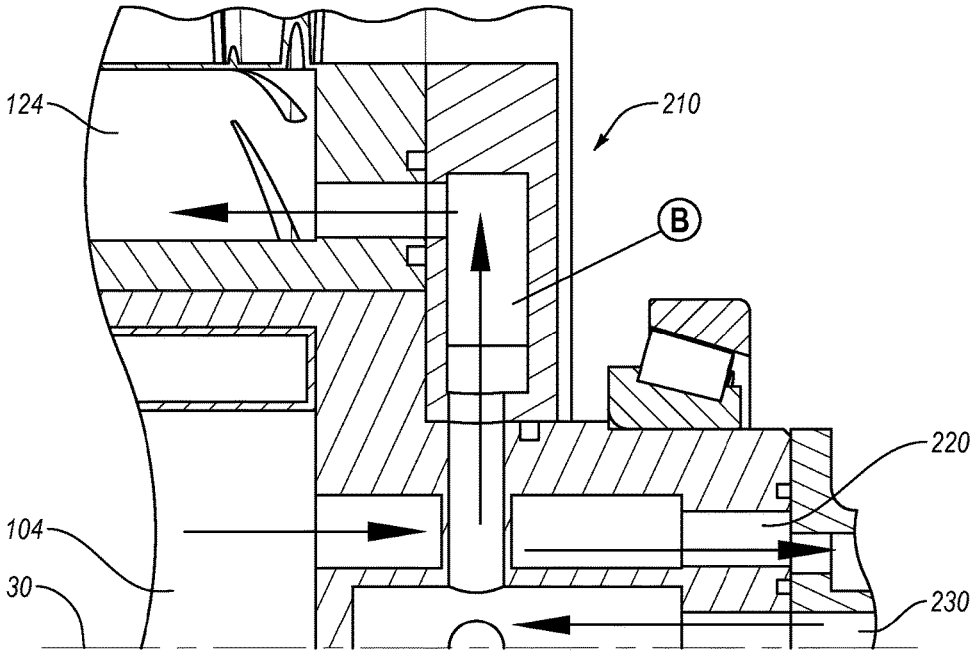
FIG. 2B is an enlarged side cross-sectional view of a portion of the hot-side heat exchanger of FIG. 2A.

In at least one embodiment, connecting conduit 103 may include a core channel 104. The refrigerant in the core channel 104 may flow and/or may be forced into the compressor 140, where the refrigerant may be compressed thereby. More specifically, in an embodiment, the compressor 140 may be in fluid communication with the core channel 104 (as shown in FIG. 2B and described below in more detail). For instance, the blades 121 may be hollow and/or may include one or more channels, such that the compressed refrigerant channel 124 may be in fluid communication with the condensed refrigerant channel 127 through the channel(s) in the blades 121. As such, the compressed refrigerant may flow from the compressed refrigerant channel 124 into the condensed refrigerant channel 127, while being cooled in the blades 121.

For example, the channel(s) passing through the blades 121, at one end, may terminate at openings 129*a* inside the compressed refrigerant channel 124, and at another end, may terminate at openings 129*b* inside the condensed refrigerant channel 127. Hence, the compressed refrigerant in the compressed refrigerant channel 124 may enter the blades 121 through the openings 129*a* and may exit the blades 121 (e.g., after cooling therein) through the openings 129*b* into the condensed refrigerant channel 127.

Furthermore, in an embodiment, the cooled and/or condensed refrigerant may pass from the condensed refrigerant channel 127 into a refrigerant outlet channel 170. For instance, the refrigerant outlet channel 170 may be formed by and between the inner shell 122 and core shaft 106 and may be separated from the compressed refrigerant channel 124 by a divider. Hence, for example, the hot-side heat exchanger 120 may include a cooling portion 180 and an outlet portion 190. Specifically, along the cooling portion 180, the compressed refrigerant may flow out of the compressed refrigerant channel 124 and into the condensed refrigerant channel 127, while along the outlet portion 190, the condensed refrigerant may flow from the condensed refrigerant channel 127 (through the blades 121) into the refrigerant outlet channel 170. Additionally or alternatively, the core channel 104 may be separated from the compressed refrigerant channel 124 by insulation 105, which may prevent or reduce heat transfer between the refrigerant in the core channel 104 and compressed refrigerant in the compressed refrigerant channel 124 (FIGS. 2A-2B).

In some embodiments, from the refrigerant outlet channel 170, the condensed refrigerant may enter a connector channel 200 through one or more ports 171. As described below in more detail, the condensed refrigerant may flow toward the cold-side of the heat pump (e.g., into the evaporator) through the connector channel 200. In other words, the refrigerant may be compressed by the compressor 140 and may enter the compressed refrigerant channel 124 therefrom. Subsequently, the refrigerant may enter the blades 121 from the compressed refrigerant channel 124 and may be cooled and condensed therein as the hot-side heat exchanger 120 rotates and/or as cooling medium passes over the blades 121. After passing through the blades 121, the compressed and condensed refrigerant may enter the condensed refrigerant channel 127 and move along the condensed refrigerant channel 127 toward the cold side of the heat pump, as indicated with the arrows. Furthermore, the condensed refrigerant may flow from the condensed refrigerant channel 127 across the blades 121 (located in the outlet portion 190 of the hot-side heat exchanger 120) and into the refrigerant outlet channel 170, where the condensed refrigerant may be distributed through the orifices 171 into the connector channel 200 (or, in some instances, into multiple connector channels) and toward the cold-side heat exchanger (e.g., evaporator).

Again, the compressed refrigerant may flow from the compressor into the compressed refrigerant channel 124 of the hot-side heat exchanger 120. FIG. 2B illustrates an enlarged view of a connection between the compressor 140 and the hot-side heat exchanger 120 according to at least one embodiment. Generally, the compressor may be connect to the hot-side heat exchanger in a manner that the compressed refrigerant may exit the compressor and enter the compressed refrigerant channel 124, and the expanded refrigerant may exit the core channel 104 and enter the compressor. For example, a coupling 210 may connect the compressor to the hot-side heat exchanger. The coupling 210 may be connected to the compressor and/or hot-side heat exchanger or may be integrated with the compressor and/or with the hot-side heat exchanger.

In an embodiment, the coupling 210 may include an inlet channel 220 that may be in fluid communication with the core channel 104. Hence, the expanded and/or evaporated refrigerant may flow from the core channel 104, through the inlet channel 220, and into the compressor. Additionally or alternatively, the coupling 210 may include an outflow channel 230 that may be in fluid communication with the compressed refrigerant channel 124, such that the compressed refrigerant exiting the compressor may enter the compressed refrigerant channel 124 through the outflow channel 230 and may subsequently flow into the hot-side heat exchanger. In any case, the coupling 210 may facilitate suitable circulation of the refrigerant into and out of the compressor.

Figure 2C:
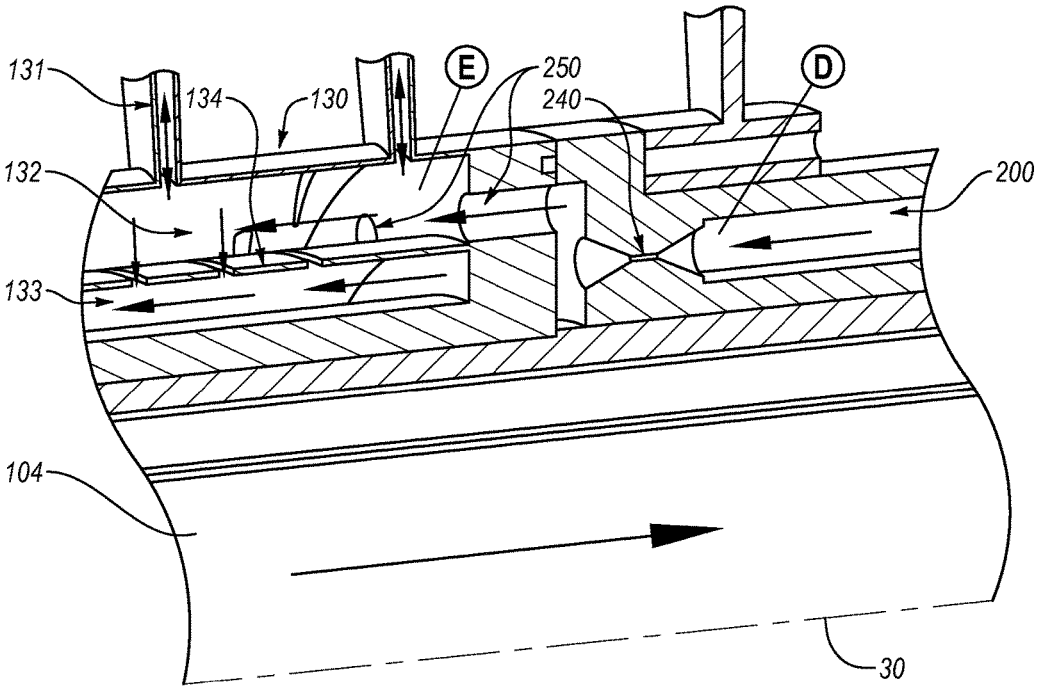
FIG. 2C is an enlarged view of a portion of a cold-side heat exchanger according to an embodiment.
Figure 2D:
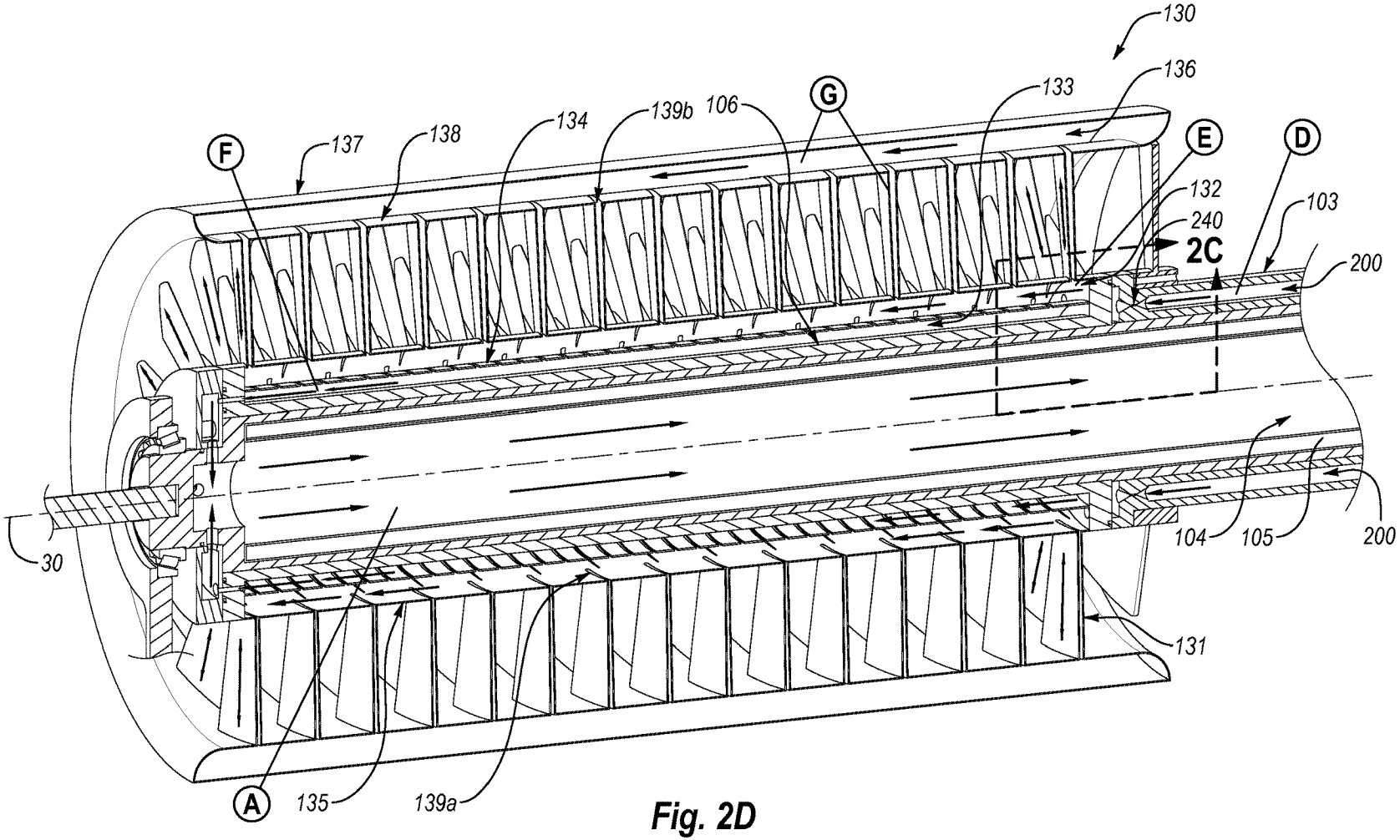
FIG. 2D is a full, isometric, cutaway view of the cold-side heat exchanger of FIG. 2C.

As described above, the condensed refrigerant may flow from the hot-side heat exchanger toward the cold-side heat exchanger across the connector channel therebetween. Furthermore, as shown in FIG. 2C, from the connector channel 200, the condensed refrigerant may pass through an expansion valve 240 before entering the cold-side heat exchanger 130. Expansion of the condensed refrigerant (after passing through the expansion valve 240) may reduce the temperature thereof. Moreover, the expansion valve 240 may be configured to produce a suitable pressure drop for a single phase refrigerant (e.g., liquid-phase) and/or for two-phase refrigerant (e.g., gas-phase and liquid-phase). Additionally or alternatively, the refrigerant expansion may take place across a work extracting element, such as a turbine, which may reduce the pressure and temperature of the compressed refrigerant. In other embodiments, the expansion valve may comprise one or more orifices or capillary tubes. In any case, the refrigerant flow after expansion may consist of both liquid and gas phases. It should be appreciated that the heat pump may include any number of expansion valves, which may have any suitable size and/or configuration.

In some embodiments, as shown in FIG. 2C, the expanded refrigerant may enter the cold-side heat exchanger 130 through one or more ports 250 (after passing across the expansion valve 240). The expanded refrigerant may flow from the expansion valve 240 into one or more blades 131 of the cold-side heat exchanger 130. For example, from the expansion valve 240, the expanded refrigerant may flow into an upper inner channel 132 and into the blades 131. The cold-side heat exchanger 130 may rotate about the rotation axis 30; such rotation may force the liquid-phase of the expanded refrigerant away from the rotation axis 30 (under centrifugal force) and into the blades 131. Also, the liquid-phase refrigerant may be heated in the blades 131 (as a medium, such as air, passes through the cold-side heat exchanger 130 and across the blades 131) and at least some of the refrigerant may evaporate (i.e., transition to gas phase) as a result of such heating.

Moreover, as described below in more detail, the liquid-phase of the refrigerant may separate from the gas-phase refrigerant in the cold-side heat exchanger 130 (e.g., in the blades 131 and/or in the upper inner channel 132). For example, the gas-phase refrigerant may be forced to flow into a lower inner channel 133 and may flow therein (as indicated within the arrows). In an embodiment, the upper inner channel 132 and the lower inner channel 133 may be separated by a perforated wall 134, which may include one or more openings that may allow the gas-phase refrigerant to pass from the upper inner channel 132 into the lower inner channel 133. Furthermore, the gas-phase refrigerant may flow from the lower inner channel 133 into the core channel 104, as shown in FIG. 2D and described in more detail below.

Generally, as illustrated in FIG. 2D, the cold-side heat exchanger 130 may rotate about the rotation axis 30, as mentioned above. In some embodiments, as the cold-side heat exchanger 130 rotates about the rotation axis 30, the liquid-phase refrigerant may be forced away from the rotation axis 30 and into the blades 131 of the cold-side heat exchanger 130. For example, the blades 131 may be attached or connected to an inner shell 135 that may be attached to the core shaft 106 of the connecting conduit 103 (e.g., in a similar manner that the inner shell 122 of the hot-side heat exchanger 120 may be attached to the core shaft 106 (FIG. 2A)). In an embodiment, the upper inner channel 132 and/or lower inner channel 133 may be defined by and between the inner shell 135 and core shaft 106.

For instance, the core shaft 106 and inner shell 135 may define a single channel that may be separated or divided into the upper inner channel 132 and lower inner channel 133 by perforated wall 134. In any event, the cold-side heat exchanger 130 may include the upper inner channel 132 and lower inner channel 133 that may facilitate separation and/or separate flow of gas-phase and liquid-phase refrigerant in the cold-side heat exchanger 130. Moreover, in an embodiment, as mentioned above, the connecting conduit 103 may span between and/or connect together the hot-side heat exchanger 120 (FIGS. 1A-2A) and the cold-side heat exchanger 130. As such, for instance, rotation of the connecting conduit 103 about the rotation axis 30 may produce corresponding rotation of the hot-side heat exchanger 120 (FIG. 2A) and cold-side heat exchanger 130 and/or one or more components or elements thereof.

The cold-side heat exchanger 130 also may include outer channel 136 that may extend along the cold-side heat exchanger 130. More specifically, in an embodiment, the liquid-phase refrigerant may be forced into the outer channel 136 from the blades 131. The outer channel 136 may be formed by and between an outer shell 137 and blade casing 138 of the cold-side heat exchanger 130 (e.g., in a similar manner, such that the condensed refrigerant channel 127 may be formed by and between the outer shell 125 and blade casing 126 of the hot-side heat exchanger 120 (FIG. 2A)). In other words, the outer shell 137 and blade casing 138 may define an at least partially enclosed space of the outer channel 136 (e.g., the outer shell 137 and blade casing 138 may form an approximately cylindrical outer channel 136).

In at least one embodiment, the liquid-phase refrigerant may flow from the upper inner channel 132 through the blades 131 and into the outer channel 136 (i.e., the blades 131 may provide fluid communication between the outer channel 136 and the upper inner channel 132). The blades 131 may have openings such as 139*a* at a first end thereof (i.e., at the end attached to the inner shell 135), such that the blades 131 are in fluid communication with the upper inner channel 132 through the openings 139*a*. The blades 131 also may have a second opening 139*b* at a second, opposite end thereof (i.e., at the second end, the blades 131 may attach to the blade casing 138, such that the openings 139*b* are in fluid communication with the outer channel 136). In any case, the blades 131 may provide fluid communication between the upper inner channel 132 and outer channel 136 in a manner that facilitates flow of the liquid-phase refrigerant from the upper inner channel 132 into the outer channel 136. Moreover, the blades 131 may facilitate flow of the gas-phase refrigerant from the blades 131 and/or from the outer channel 136 into upper inner channel 132 (and, subsequently, into the lower inner channel 133).

In an embodiment, the evaporated or gas-phase refrigerant may exit the lower inner channel 133 into the core channel 104. For instance, at an end of the cold-side heat exchanger 130 and/or of the lower inner channel 133, which may be opposite to the expansion valve 240, the lower inner channel 133 may connect with the core channel 104 (e.g., through one or more channels that may be in fluid communication with the core channel 104). Hence, after entering the cold-side heat exchanger 130 through the expansion valve 240 and evaporating in the cold-side heat exchanger 130 (e.g., in the blades 131 and/or in the outer channel 136 of the cold-side heat exchanger 130), the gas-phase refrigerant may enter the core channel 104 and may flow toward the compressor (as indicated with the arrows). More specifically, for example as described above, the gas-phase refrigerant may flow into the compressor 140 (FIG. 2A), may be compressed therein and may flow into the hot-side heat exchanger 120 (FIG. 2A), where the gas-phase refrigerant may be condensed, in a manner described above. Moreover, the heat pump including the cold-side heat exchanger 130 and hot-side heat exchanger 120 (FIG. 2A) may operate continuously to cool the cold-side medium that may pass through the cold-side heat exchanger 130 and/or to heat the hot-side medium that may pass through the hot-side heat exchanger 120 (FIG. 2A).

In one or more embodiments, as the cold-side heat exchanger 130 rotates and/or as the cold-side medium passes about and/or across the blades 131 of the cold-side heat exchanger 130, heat from the cold-side medium may be transferred to the blades 131 and to the liquid-phase refrigerant therein, thereby heating the liquid-phase refrigerant and cooling the cold-side medium. In some embodiments, the heat transferred from the cold-side medium may evaporate at least a portion of the liquid-phase refrigerant in the channels within the blades 131. Moreover, as described in further detail below, the gas-phase refrigerant may separate from the liquid-phase refrigerant, such that the gas-phase refrigerant flows toward the rotation axis 30 (e.g., into the lower inner channel 133) and the liquid-phase refrigerant flows away from the rotation axis 30 (e.g., from the upper inner channel 132 toward and/or into the outer channel 136).

Figure 3:
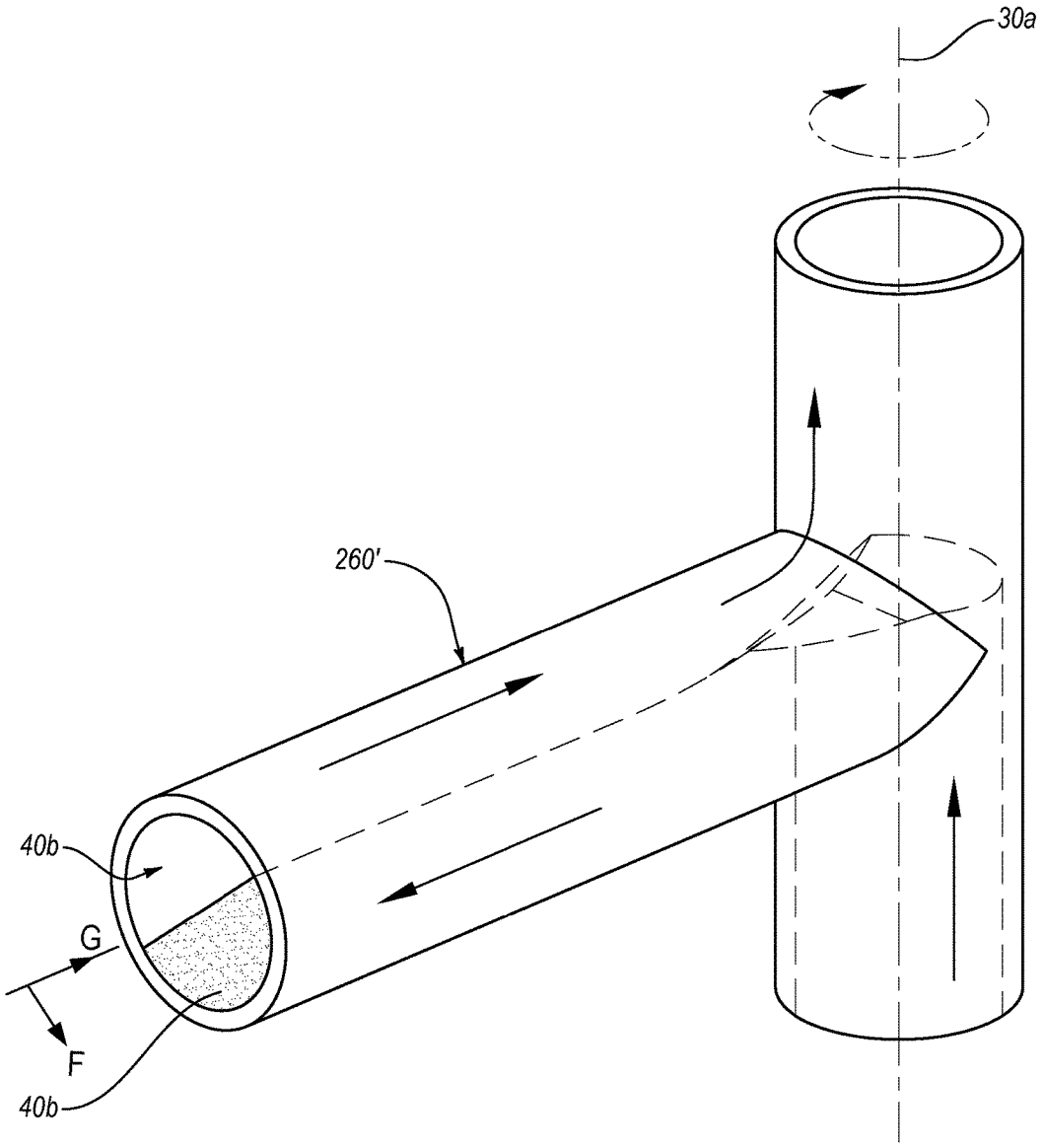
FIG. 3 is an isometric view of schematic representation of a blade of a cold-side or hot-side heat exchanger according to an embodiment.

FIG. 3 illustrates a schematic representation of a blade 260' that includes a single channel and flow of liquid-phase refrigerant 40*a* and gas-phase refrigerant 40*b* within the blade 260'. It should be appreciated that the blade 260' may be representative of a blade in a hot-side heat exchanger and/or in the cold-side heat exchanger. As described above, rotation of the blade 260' about the rotation axis 30*a* may produce centrifugal acceleration that may force the liquid-phase refrigerant 40*a* away from the rotation axis 30*a* (as indicated with the arrow) and the gas-phase refrigerant towards the rotation axis 30*a* due to the difference in the densities between the liquid and gas phases (as shown with another arrow). Additionally, the liquid-phase refrigerant 40*a* may squeeze out the gas-phase refrigerant 40*b* in a manner that forces the gas-phase refrigerant 40*b* to flow toward the rotation axis 30*a*. In any event, in some embodiments, rotation of the hot-side and/or cold-side heat exchanger that includes the blade 260' may produce a suitable flow of the liquid-phase refrigerant 40*a* away from the rotation axis 30*a* (e.g., out of the upper inner channel of the cold-side heat exchanger) and an opposite flow of the gas-phase refrigerant 40*b* (e.g., into the lower inner channel of the cold-side heat exchanger), thereby separating the liquid-phase refrigerant 40*a* from the gas-phase refrigerant 40*b*. Furthermore, as the blade 260' rotates about rotation axis 30*a*, the opposing flow of the liquid and gas phase refrigerant may generate Coriolis accelerations F, which may force the liquid-phase refrigerant 40*a* away from a center of the channel of the blade 260' and against one or more sides thereof, even in the presence of gravity G (in the downward direction in FIG. 3). The opposing liquid-phase and gas-phase flows may therefore become stratified in the same channel. It should also be appreciated that the opposing flow of the liquid and vapor phases draws significant similarities with flow characteristics in the evaporators of (gravity driven) thermosyphons, which inherently operates with stratified flow under normal operating conditions.

Generally, as mentioned above, in one or more embodiments, the hot-side and cold-side heat exchangers may rotate together. In some instances, the hot-side and cold-side heat exchangers may be approximately coaxial (i.e., may rotate about the same rotation axis) and may be longitudinally spaced from each other (e.g., as shown in FIGS. 1A-1B). Alternatively or additionally, the hot-side and cold-side heat exchangers may be coaxially and concentrically positioned relative to each other. For example, FIGS. 9A and 9B illustrate a heat pump 100*a* that includes a hot-side heat exchanger 120*a* and a cold-side heat exchanger 130*a* concentrically located relative to each other about a rotation axis 30*a*".

Figure 9A:
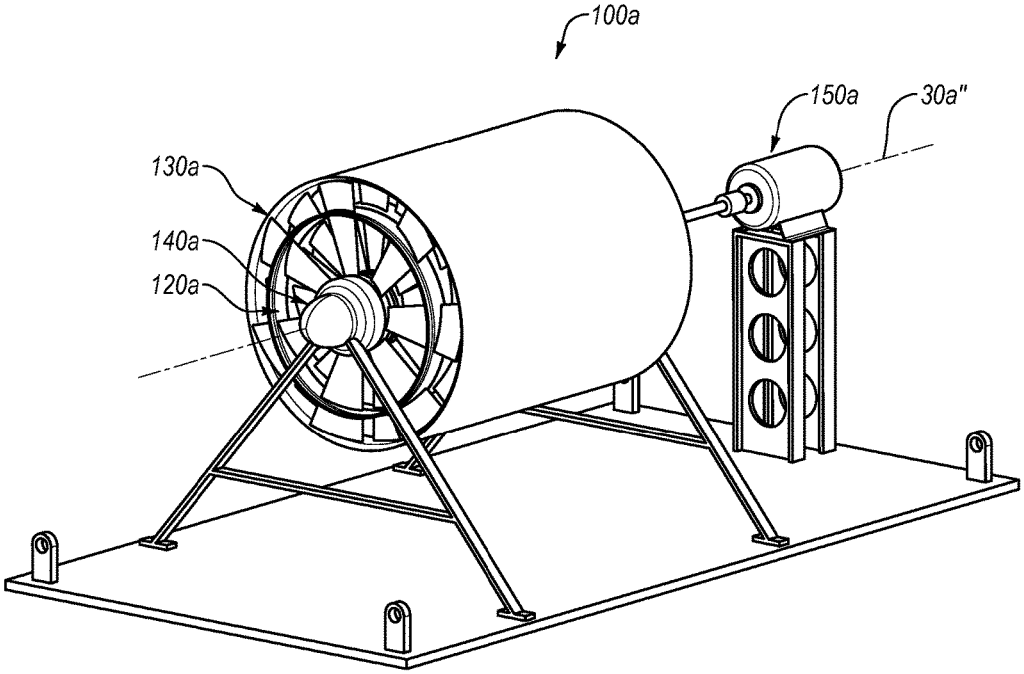
FIG. 9A is an isometric view of a heat pump according to an embodiment.
Figure 9B:
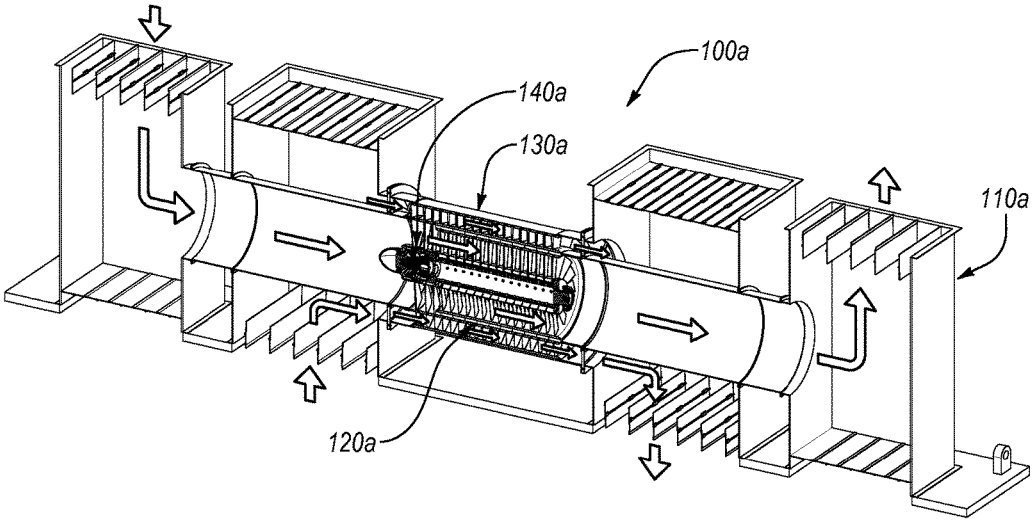
FIG. 9B is an isometric view of the heat pump of FIG. 9A in combination with ductwork according to an embodiment.

More specifically, as shown in FIG. 9A, in at least one embodiment, the hot-side heat exchanger 120*a* may be positioned inside the cold-side heat exchanger 130*a*. Hence, as described below in more detail, refrigerant may be compressed by a compressor 140*a* and may flow and/or may be forced into the hot-side heat exchanger 120*a*. For example, compressed, gas-phase refrigerant may be condensed in the hot-side heat exchanger 120*a* to a liquid-phase refrigerant, which may flow and/or may be forced into the cold-side heat exchanger 130*a*. Furthermore, in the cold-side heat exchanger 130*a*, the liquid-phase refrigerant may be expanded and may be evaporated when heated by the medium passing through the cold-side heat exchanger 130*a* and exchanging heat with the liquid-phase refrigerant. The evaporated, gas-phase refrigerant may be directed toward and/or into the compressor 140*a* for compression. It should be also appreciated that the heat pump 100*a* may be operated in a manner that creates a continuous refrigeration cycle.

In some embodiments, the hot-side heat exchanger 120*a* and cold-side heat exchanger 130*a* may rotate together as a single unit. For instance, the heat pump 100*a* may include a motor 150*a* operatively connected to the hot-side heat exchanger 120*a* and/or cold-side heat exchanger 130*a* (e.g., a drive shaft may connect the motor 150*a* to the hot-side heat exchanger 120*a*, which may be connected to the cold-side heat exchanger 130*a*).

Furthermore, the media may be directed to flow into the hot-side heat exchanger 120*a* and cold-side heat exchanger 130*a* to respectively heat and cool such media and/or to respectively cool and heat the refrigerant in the hot-side heat exchanger 120*a* and cold-side heat exchanger 130*a*. More specifically, in an embodiment, the heat pump 100*a* may include and/or may be connected to ductwork 110*a*, which may distribute the medium into the hot-side heat exchanger 120*a* and cold-side heat exchanger 130*a*. For example, to cool air inside a chamber (e.g., a building, room, compartment, etc.), the ductwork 110*a* may direct air from the chamber into the cold-side heat exchanger 130*a* and back into the chamber after the air passes through the cold-side heat exchanger 130*a*. Conversely, for instance, to heat air in the chamber, the connected ductwork 110*a* may direct air into the hot-side heat exchanger 120*a* and back into the chamber after the air exits the hot-side heat exchanger 120*a*. The arrows shown in FIG. 9B illustrate the flow of the chamber and ambient air through the ductwork in the case where the chamber air is cooled and the ambient air is heated.

Figure 10A:
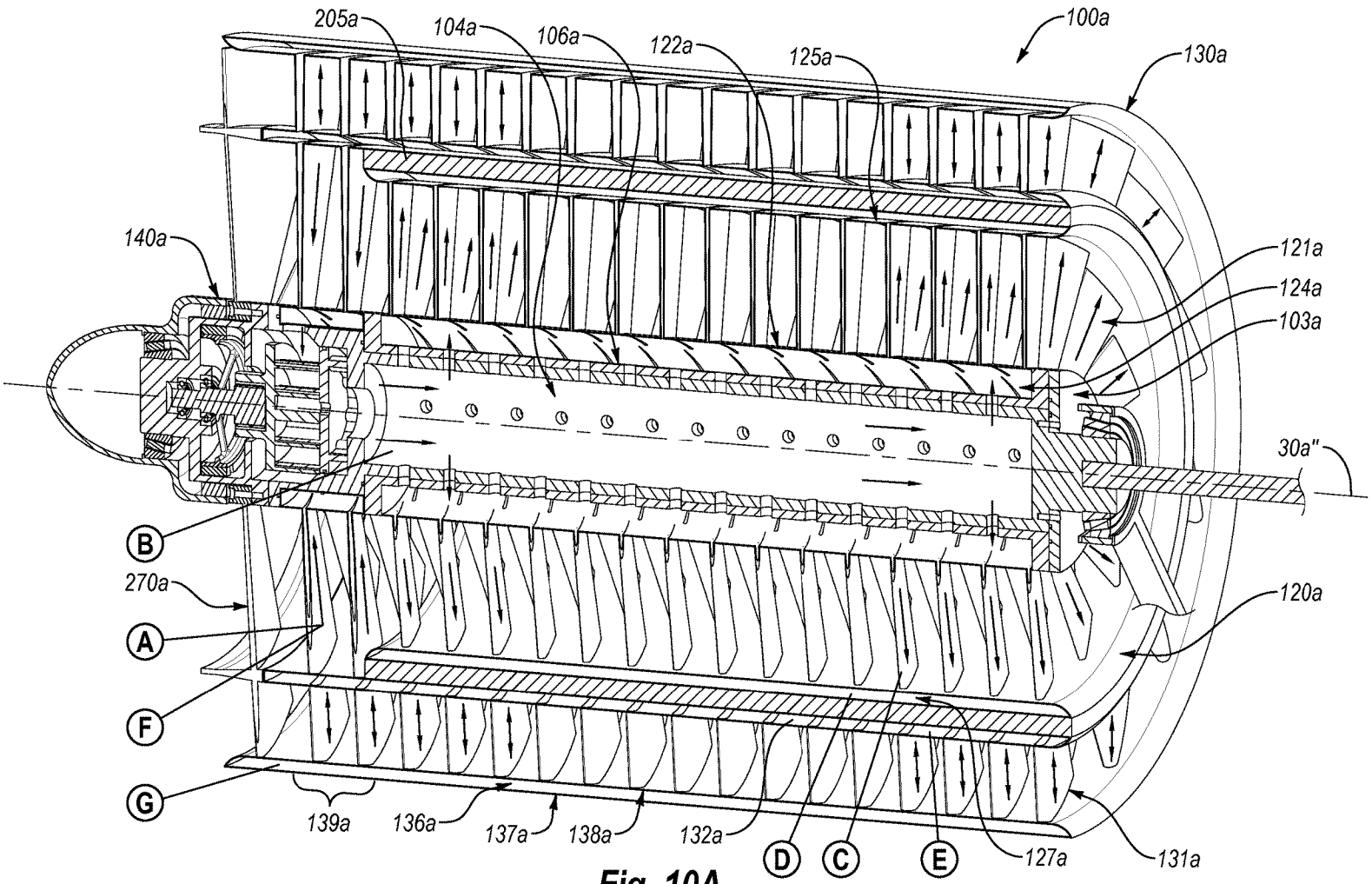
FIG. 10A is an isometric, cutaway view of the heat pump of FIG. 9A.

As shown in FIG. 10A, the hot-side heat exchanger 120*a* and cold-side heat exchanger 130*a* may be secured to a connecting conduit 103*a*, which may be rotated by the motor together with the hot-side heat exchanger 120*a* and cold-side heat exchanger 130*a*. Furthermore, the connecting conduit 103*a* may include a core channel 104*a* in fluid communication with the compressor 140*a*. In particular, compressed refrigerant may exit the compressor 140*a* into the core channel 104*a* of the connecting conduit 103*a*. In some embodiments, the compressed refrigerant may flow from the core channel 104*a* into a compressed refrigerant channel 124*a* of the hot-side heat exchanger 120*a*. For example, the compressed refrigerant channel 124*a* may be formed by and between an inner shell 122*a*, which may be secured or attached to the connecting conduit 103*a*, and the core shaft 106*a* of the connected conduit 103*a* (e.g., the inner shell 122*a* may be secured or attached to the core shaft 106*a* in a manner that forms or defines an enclosed compressed refrigerant channel 124*a*).

Also, in at least one embodiment, the hot-side heat exchanger 120*a* may include blades 121*a* that may be attached to and/or between the inner shell 122*a* and a blade casing 125*a* (e.g., the blades 121*a* may secure the blade casing 125*a* to the inner shell 122*a* of the hot-side heat exchanger 120*a*). Moreover, the compressed refrigerant (e.g., gas-phase compressed refrigerant) may enter the compressed refrigerant channel 124*a* from the core channel 104*a* and may further flow or may be forced into the blades 121*a* (e.g., the blades 121*a* may be similar to one or more of the blades described herein and may include one or more channels therein). For example, the core channel 104*a* may include multiple perforations or openings providing fluid communication between the core channel 104*a* and the compressed refrigerant channel 124*a* (i.e., the refrigerant may flow through the openings in the core channel 104*a* into the compressed refrigerant channel 124*a*).

In some embodiments, the refrigerant may flow or may be forced into a condensed refrigerant channel 127*a*, which may be formed by and between the blade casing 125*a* and an insulation layer 205 that may be positioned between the hot-side heat exchanger 120*a* and cold-side heat exchanger 130*a*. The blades 121*a* may extend between the inner shell 122*a* and the blade casing 125*a* and may be secured thereto. Also, the channel(s) of the blades 121*a* may be in fluid communication with the compressed refrigerant channel 124*a* and condensed refrigerant channel 127*a*.

In an embodiment, at least some of the gas-phase refrigerant may condense in the blades 121*a* of the hot-side heat exchanger 120*a* and compressed, liquid-phase refrigerant may enter the condensed refrigerant channel 127*a* (e.g., as described above in connection with the heat pump 100 (FIGS. 1A-2D). For instance, a medium may pass through the hot-side heat exchanger 120*a* and over the blades 121*a* in a manner that cools and condenses the compressed, gas-phase refrigerant therein. Also, as the hot-side heat exchanger 120*a* rotates about the rotation axis 30*a*", the compressed, liquid-phase refrigerant may experience greater centrifugal forces than the gas-phase refrigerant, and may be centrifugally forced into the condensed refrigerant channel 127*a*.

Additionally or alternatively, the compressed, liquid-phase refrigerant may expand into the cold-side heat exchanger 130*a*. For example, the compressed, liquid-phase refrigerant may pass through one or more expansion valves throttle valves, or orifices located between the hot-side heat exchanger 120*a* and the cold-side heat exchanger 130*a* and may enter an inner channel 132*a* of the cold-side heat exchanger 130*a*. The inner channel 132*a* may be formed by and between the insulation layer 205 and an inner shell 135*a* of the cold-side heat exchanger 130*a*. In some embodiments, the liquid-phase refrigerant may enter blades 131*a* of the cold-side heat exchanger 130*a* (i.e., the blades 131*a* of the cold-side heat exchanger 130*a* may be in fluid communication with the inner channel 132*a*, such that the liquid-phase, expanded refrigerant may enter one or more channels of the blades 131*a*, as described above).

As mentioned above, after expansion, the temperature of the liquid-phase refrigerant drops. As medium passes through the cold-side heat exchanger 130*a* and/or about the blades 131*a*, the heat from the medium may be transferred to the refrigerant. Hence, in some instances, at least some of the refrigerant may be heated sufficiently to evaporate or form gas-phase refrigerant that may be centrifugally separated from the liquid-phase refrigerant as the cold-side heat exchanger 130*a* rotates about rotation axis 30*a*", in a manner described above. More specifically, the gas-phase refrigerant may flow and/or may be forced back into the inner channel 132*a* and toward the compressor 140*a*. For instance, the gas-phase refrigerant may be forced toward a return section 139*a* of the cold-side heat exchanger 130*a* and may flow across the blades 131*a* located in the return section 139*a* and into the compressor 140*a*.

In some embodiments, the cold-side heat exchanger 130*a* also may include an outer channel 136*a* that may be formed or defined by and between an outer shell 137*a* and blade casing 138*a*. For example, the expanded, liquid-phase refrigerant may be forced into the outer channel 136*a* under centrifugal forces as the cold-side heat exchanger 130*a* rotates about the rotation axis 30*a*". In some examples, at least some of the expanded, liquid-phase refrigerant in the outer channel 136*a* may be evaporated in the same manner as in the blades 131*a*. In any event, the evaporated, gas-phase refrigerant in the cold-side heat exchanger 130*a* may flow and/or maybe forced into the compressor 140*a*, as indicated with the arrows in the return section 139*a*.

In some embodiments, as mentioned above, the blades 121*a* and/or the blades 131*a* of the heat pump 100*a* may comprise an impeller-like or propeller-like configuration, such that the blades 121*a* and/or the blades 131*a* may force media (e.g., air) through the respective hot-side heat exchanger 120*a* and cold-side heat exchanger 130*a*. Additionally or alternatively, the heat pump 100*a* may include one or more fans, blowers, blades configured to advance medium through the hot-side heat exchanger 120*a* and/or cold-side heat exchanger 130, or combinations thereof. For example, the heat pump 100*a* may include propeller blades 270*a* secured to the hot-side heat exchanger 120*a* and/or cold-side heat exchanger 130*a* and/or the connecting conduit 103*a* and configured to advance medium therethrough (e.g., the propeller blades 270*a* may be rotatably or fixedly secured to the hot-side heat exchanger 120*a* and/or to the cold-side heat exchanger 130*a* (e.g., the propeller blades 270*a* may rotate independently of the hot-side heat exchanger 120*a* and/or cold-side heat exchanger 130*a* or together therewith). It should also be appreciated that the hot-side heat exchanger 120 and cold-side heat exchanger 130 (FIGS. 1A-2D) also may include one or more propeller blades and/or one or more sets of propeller blades that may rotate together with the hot-side heat exchanger 120 and/or cold-side heat exchanger 130 (FIGS. 1A-2D) or together therewith.

Figure 4A:
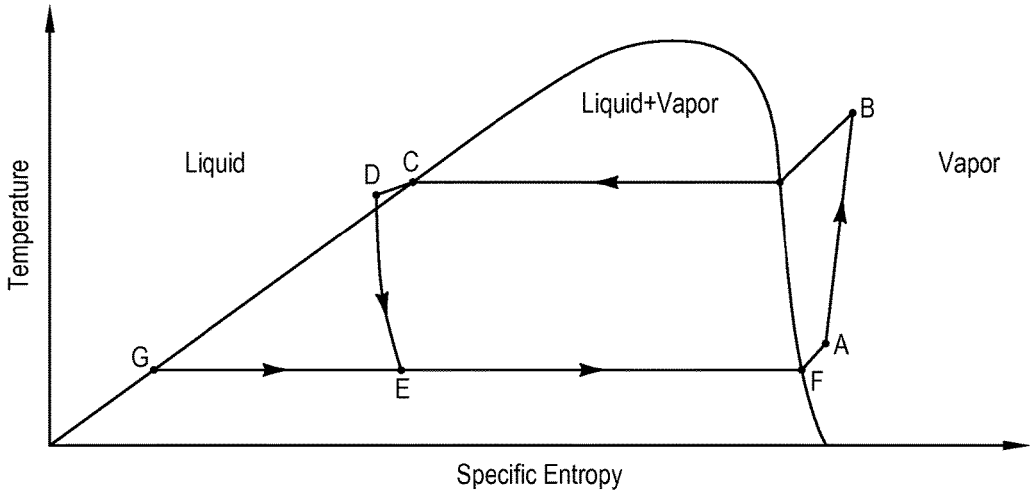
FIG. 4A is a phase diagram illustrating a refrigeration cycle during operation of a heat pump according to an embodiment.

In any event, the heat pump that includes hot-side and/or cold-side heat exchangers with multiple blades (e.g., similar in operation to the blade 260') may operate continuously to heat and/or cool media on respective hot and cold sides thereof. Generally, however, the refrigeration cycle of the heat pump may vary from one embodiment to the next. FIG. 4A illustrates a refrigeration cycle, which may occur during operation of the heat pump 100 (FIGS. 1A-2D) according to at least one embodiment. In particular, the refrigeration cycle is shown on a phase diagram of the refrigerant at various locations or points in the heat pump (on a graph of Temperature vs. Specific Entropy of the refrigerant). For purposes of illustration, points A-F of the graph are identified with corresponding locations A-F of the refrigerant in the heat pump (FIGS. 2A-2D), as the refrigerant is cycled or circulated through the heat pump.

Starting at point A, for example, the refrigerant may be in the gas phase (e.g., the gas-phase refrigerant may be located in the core channel 104 (FIGS. 2A, 2D). The gas-phase refrigerant may enter the compressor (e.g., the compressor 140 (FIG. 2A)) and may be compressed therein to a suitable pressure. Furthermore, after compression, at a point B, the gas-phase refrigerant may exit the compressor at a higher temperature and higher pressure than the gas-phase refrigerant at point A. As described above, the compressed, gas-phase refrigerant may enter a condenser or hot-side heat exchanger that releases heat to a hot-side medium (e.g., the hot-side heat exchanger 120 FIG. 2A)) and may cool and condense therein to liquid phase at point C. For instance, a hot-side medium that may be cooler than the condensation temperature of the refrigerant may pass through the condenser, which may facilitate heat exchange between the hot-side medium and the compressed, gas-phase refrigerant, thereby cooling and condensing the compressed, gas-phase refrigerant (e.g., the liquid-phase refrigerant may be subcooled in the hot-side heat exchanger, such as in the return pipes thereof).

After sufficient or suitable cooling in the hot-side heat exchanger to change the phase of the gas-phase refrigerant to liquid, the liquid-phase refrigerant may exit the hot-side heat exchanger, such as at point D. In at least one embodiment, the temperature of the liquid-phase refrigerant (point D) may be lower than the condensation temperature (point C) thereof. In some embodiments, the liquid-phase, compressed refrigerant may expand before or after entering the cold-side heat exchanger (e.g., the liquid-phase refrigerant may pass through an expansion valve 240 (FIGS. 2C-2D)). More specifically, after expansion, such as at point E, the expanded, mixed, liquid and gas-phase refrigerant may have a lower temperature and pressure than the compressed, liquid-phase refrigerant at point D.

In addition, as mentioned above, the expanded refrigerant liquid-gas mixture (point E), or, as shown in the embodiment in FIG. 2D, the liquid phase component (point G) of the expanded refrigerant, may enter the blades of an evaporator or hot-side heat exchanger (e.g., the cold-side heat exchanger 130 (FIGS. 2C-2D)) and may absorb heat from a cold-side medium that may pass through the cold-side heat exchanger (i.e., the cold-side heat exchanger may facilitate or exchange heat between the cold-side medium and the expanded, liquid-phase refrigerant). In one or more embodiments, the heat transferred from the cold-side medium may sufficiently heat the expanded, liquid-phase refrigerant to completely evaporate or change the phase of the expanded, liquid-phase refrigerant to gas phase at point F.

The gas-phase refrigerant at point F may flow toward the point A of the cycle (e.g., the gas-phase refrigerant may enter the core channel 104). In some embodiments, the gas-phase refrigerant from point F to point A may be heated or superheated (e.g., inside the core channel 104 (FIGS. 2A-2D), to assure that the refrigerant entering the compressor is in the gas phase. For example, the gas-phase refrigerant inside the core channel 104 (FIGS. 2A-2D) may be heated by the cold-side medium, by the compressed refrigerant, etc. Additionally or alternatively, the gas-phase refrigerant inside the core channel 104 (FIGS. 2A-2D) may be heated by one or more heating elements. In any event, in an embodiment, at least substantially all of the refrigerant entering the compressor may be in gas phase.

Moreover, as described above, the gas-phase refrigerant may be separated by centrifugal acceleration from the liquid-phase refrigerant inside the evaporator (e.g., in the blades 131 of the cold-side heat exchanger 130 (FIG. 2D)). For instance, the gas-phase refrigerant may enter the lower inner channel 133 (FIG. 2D) at point F, while at least some of the liquid-phase refrigerant may enter the blades 131 and/or the outer channel 136 (FIG. 2D) at point(s) G. Subsequently, the liquid-phase refrigerant from point(s) G may be evaporated, and the evaporated gas-phase refrigerant may flow toward point F (e.g., toward and/or into the lower inner channel 133) and toward point A. Also, in some embodiments, at least some of the gas-phase refrigerant may be in the blades 131 (FIG. 2D) and may flow or may be forced toward the lower inner channel 133 (FIG. 2D).

Figure 4B:
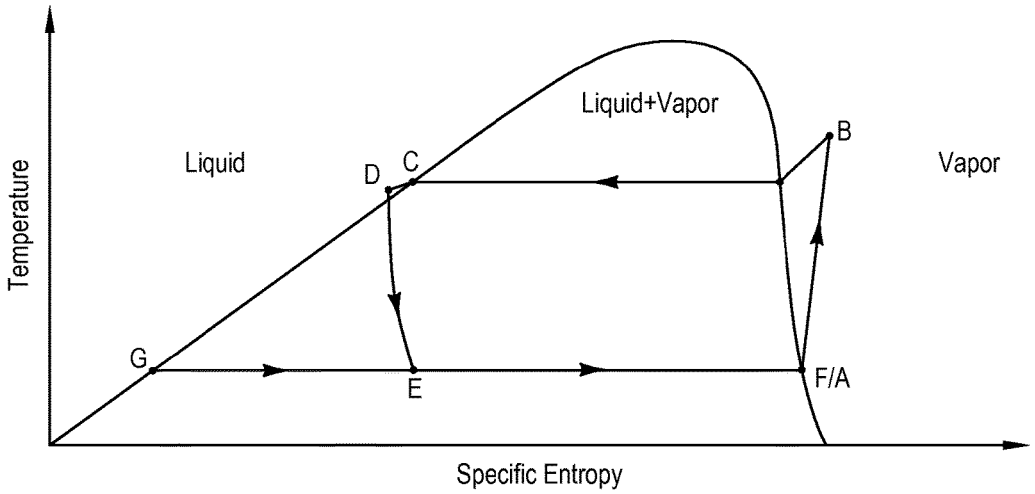
FIG. 4B is a phase diagram illustrating a refrigeration cycle during operation of a heat pump according to another embodiment.

In at least one embodiment, the refrigerant in the cold-side heat exchanger may completely evaporate before entering the conduit connected to the compressor. For example, as shown in FIG. 4B, the vapor compression cycle may have no superheating segment (i.e., heating to a temperature above the evaporation temperature of the refrigerant) to prevent liquid ingestion into the compressor 140. More specifically, in an embodiment, only the evaporated refrigerant may advance from point E to point F/A. For instance, as described above, as the cold-side heat exchanger rotates, the liquid-phase is forced away from the core channel providing fluid, while the gas-phase refrigerant may be forced toward and into the core channel that is connected to the compressor. As such, rotation and centrifugal forces produced thereby on the liquid-phase refrigerant may retain the liquid-phase refrigerant in the cold-side heat exchanger until evaporation thereof, which may prevent liquid-phase refrigerant from entering the compressor.

Figure 5:
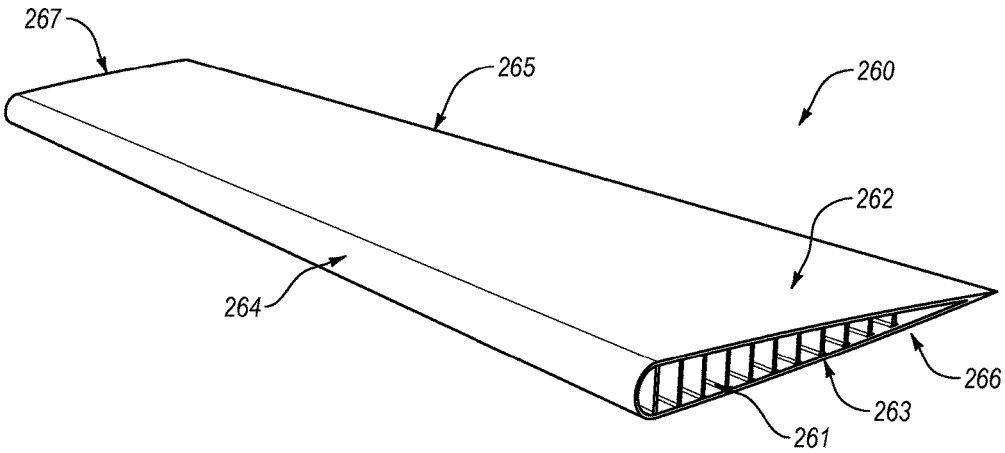
FIG. 5 is an isometric view of a blade of a cold-side or hot-side heat exchanger according to an embodiment.

While each of the blades of the compressor and/or evaporator may have a single channel therein, this disclosure is not so limited. For example, FIG. 5 illustrates a blade 260 according to an embodiment. It should be appreciated that the blade 260 may be included in the hot-side heat exchanger and/or in the cold-side heat exchanger of the heat pump (e.g., in the cold-side heat exchanger 130 and/or hot-side heat exchanger 120 (FIGS. 1A-2D)). The blade 260 may include multiple channels 261. Generally, the refrigerant may pass through the multiple channels 261 in a manner described above.

In an embodiment, the multiple channels 261 may be enclosed in and/or defined by one or more outer walls 262, 263 of the blade 260. For example, the outer walls 262, 263 may generally define the outer shape of the blade 260. Generally, the outer shape of the blade 260 may vary from one embodiment to the next. In some embodiments, the outer walls 262, 263 may define or form a wide side 264 and a narrow side or edge 265 of the blade 260. Furthermore, the wide side 264 may have an arcuate shape (e.g., the wide side 264 may be a radius connecting substantially planar portions of the outer walls 262, 263.

The channels 261 may extend between first and second ends 266, 267 of the blade 260. In particular, refrigerant may enter and exit the channels 261 of the blade 260 at the first and/or second ends 266, 267. In addition, in one or more embodiments, the channels 261 are substantially linear. Hence, the refrigerant may flow along an approximately shortest path between the first and second ends 266, 267 of the blade 260.

In some embodiments, the channels 261 may be sufficiently small, such as to prevent stratification or separation of the liquid-phase refrigerant from the gas-phase refrigerant. For example, the direction of flow of the refrigerant may be determined by the pressure produced by the compressor. Hence, in some instances, the flow of the liquid-phase refrigerant and the gas-phase refrigerant may be in the same direction.

Figure 6:
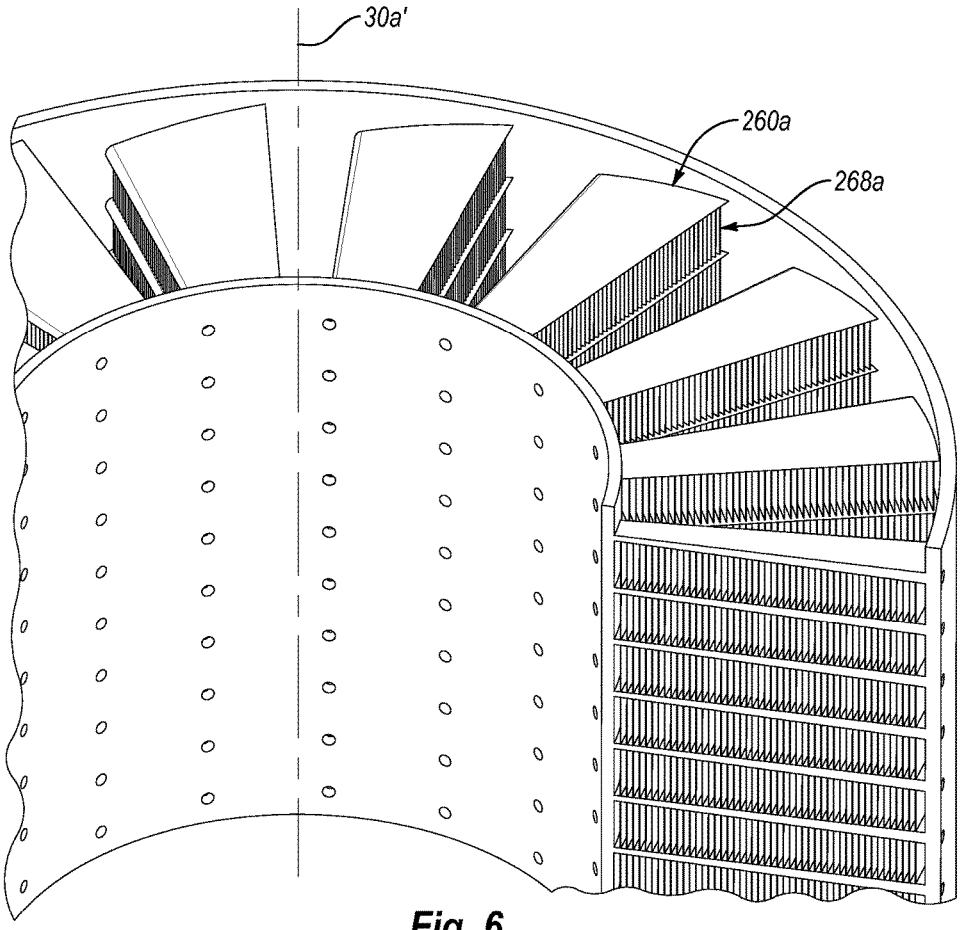
FIG. 6 is a partial isometric view of a portion cold-side or hot-side heat exchanger according to an embodiment.

Also, as shown in FIG. 6, at least some blades 260*a* of the hot-side and/or cold-side heat exchanger may include one or more plates or fins 268*a*, which may be in thermal communication with the blades 260*a* and may increase surface area of the hot-side and/or cold-side heat exchanger (i.e., surface area exposed to the medium passing through the hot-side and/or cold-side heat exchanger). For example, the fins 268*a* may extend from one or more surfaces of the blades 260*a*. In particular, for instance, the medium passing about the blades 260*a* also may pass about the fins 268*a* (e.g., as the blades 260*a* and/or fins 268*a* rotate about the rotation axis 30*a*').

Generally, the fins 268*a* may be attached to and/or incorporated with the blades 260*a*. Furthermore, as noted above, the fins 268*a* may be in thermal communication with the blade 260, such that heat may be exchanged between the blades 260*a* and fins 268*a* and the medium passing through the hot-side and/or cold-side heat exchanger and about the blades 260*a* and fins 268*a*. Likewise, heat may be exchanged between the refrigerant in the hot-side and/or cold-side heat exchanger and the blades 260*a* and fins 268*a*. Hence, in some examples, increasing surface area of the hot-side and/or cold-side heat exchanger, which is encountered by the medium passing over such surface area, may increase heat transfer between the medium and refrigerant in the corresponding hot-side and/or cold-side heat exchanger.

In some embodiments, the blades 260*a* may be interconnected with one another by the fins 268*a*. As such, for instance, the fins 268*a* may increase the structural rigidity of the blades 260*a*, as well as the entire heat exchanger assembly. Furthermore, with increased structural rigidity, thickness of the blades 260*a* may be reduced, thereby facilitating increasing the number of the blades 260*a* in the hot-side and/or cold-side heat exchanger and surface area provided thereby for heat transfer between medium and refrigerant.

Figure 7:
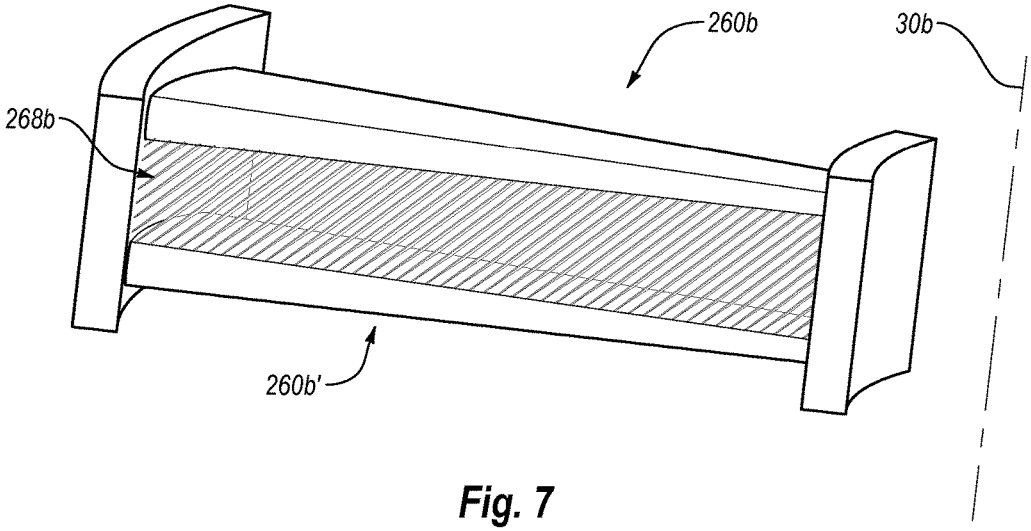
FIG. 7 is an isometric view of blades of a cold-side or hot-side heat exchanger according to an embodiment.

Moreover, according to at least one embodiment, the fins 268*a* may be approximately perpendicular to the blades 260*a* (e.g., perpendicular to one or more of the outer walls of the blades 260*a*). For instance, at least some of the fins 268*a* may be aligned approximately along and/or parallel to the rotation axis 30*a*'. Alternatively or additionally, as illustrated in FIG. 7, at least some fins may be oriented at a non-orthogonal angle. More specifically, blades 260*b*, blades 260*b*' may have fins 268*b* extending therefrom at a non-orthogonal angle relative to the outer walls thereof.

In an embodiment, the fins 268*b* may interconnect the blades 260*b* and blades 260*b*'. For example, the fins 268*b* may extend between the blades 260*b* and blades 260*b*' at approximately 45 degree angle. It should be appreciated however, that the fins 268*b* may extend between the blades 260*b* and blades 260*b*' at any suitable angle. In any event, the fins 268*b* may increase the overall surface area available for heat transfer between the medium passing through the hot-side and/or cold-side heat exchanger, which includes the blades 260*b*, blades 260*b*' and fins 268*b*, and the refrigerant (e.g., as such a hot-side and/or cold-side heat exchanger rotates about rotation axis 30*b*).

Figure 8:
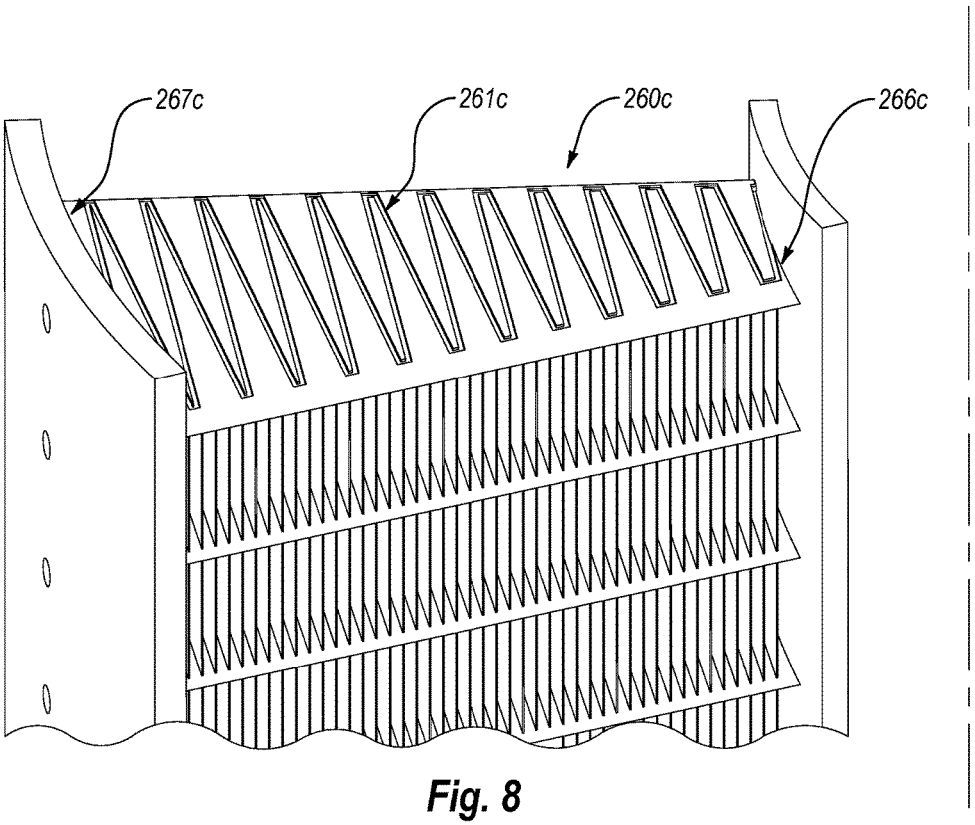
FIG. 8 is an isometric view of a portion cold-side or hot-side heat exchanger according to an embodiment.

Also, while in some embodiments one or more of the channels in the blades may be approximately linear, this disclosure is not so limited. FIG. 8 illustrates blades 260*c* that may include at least one nonlinear channel 261*c* therein. More specifically, for example, the nonlinear channels 261*c* may extend between the first and second ends 266*c*, 267*c* of the blades 260*c* in a zigzag manner, forming alternating undulations (e.g., along the widths of the blades 260*c*). As such, the refrigerant passing through the nonlinear channels 261*c* may take a longer path between the first and second ends 266*c*, 267*c* of the blades 260*c* and may take longer to flow from the first end 266*c* to the second end 267*c* (i.e., the refrigerant may spend more time inside the blades 260*c* (as compared with a blade including linear channel(s)).

Moreover, in some embodiments, maintaining the refrigerant in the blades 260*c* for a longer period of time (e.g., as compared with blades including linear channel(s)) may result in greater heat transfer between the refrigerant and the medium passing through the hot-side and/or cold-side heat exchanger that includes at least one of the blades 260*c*. For example, more refrigerant may be condensed between the first and second ends 266*c*, 267*c* and/or the temperature of the condensed or liquid-phase refrigerant exiting the blades 260*c* may be lower (as compared with blades including linear channel(s)). Alternatively, the condensation temperature may be lower for the same heat transfer load to the hot medium. Similarly, more refrigerant may be evaporated between the first and second ends 266*c*, 267*c* of the blades 260*c* and/or the temperature of the evaporated or gas-phase refrigerant exiting the blades 260*c* may be higher (as compared with blades including linear channels). Alternatively, the evaporator temperature may be higher for the same heat transfer load to the cool medium. In other words, heat transfer to the refrigerant may be improved in the cold-side heat exchanger including the blades 260*c* (or similar blades with nonlinear channels) and heat transfer from the refrigerant may be improved in the hot-side heat exchanger including the blades 260*c* (or similar blades with nonlinear channels).

Figure 10B:
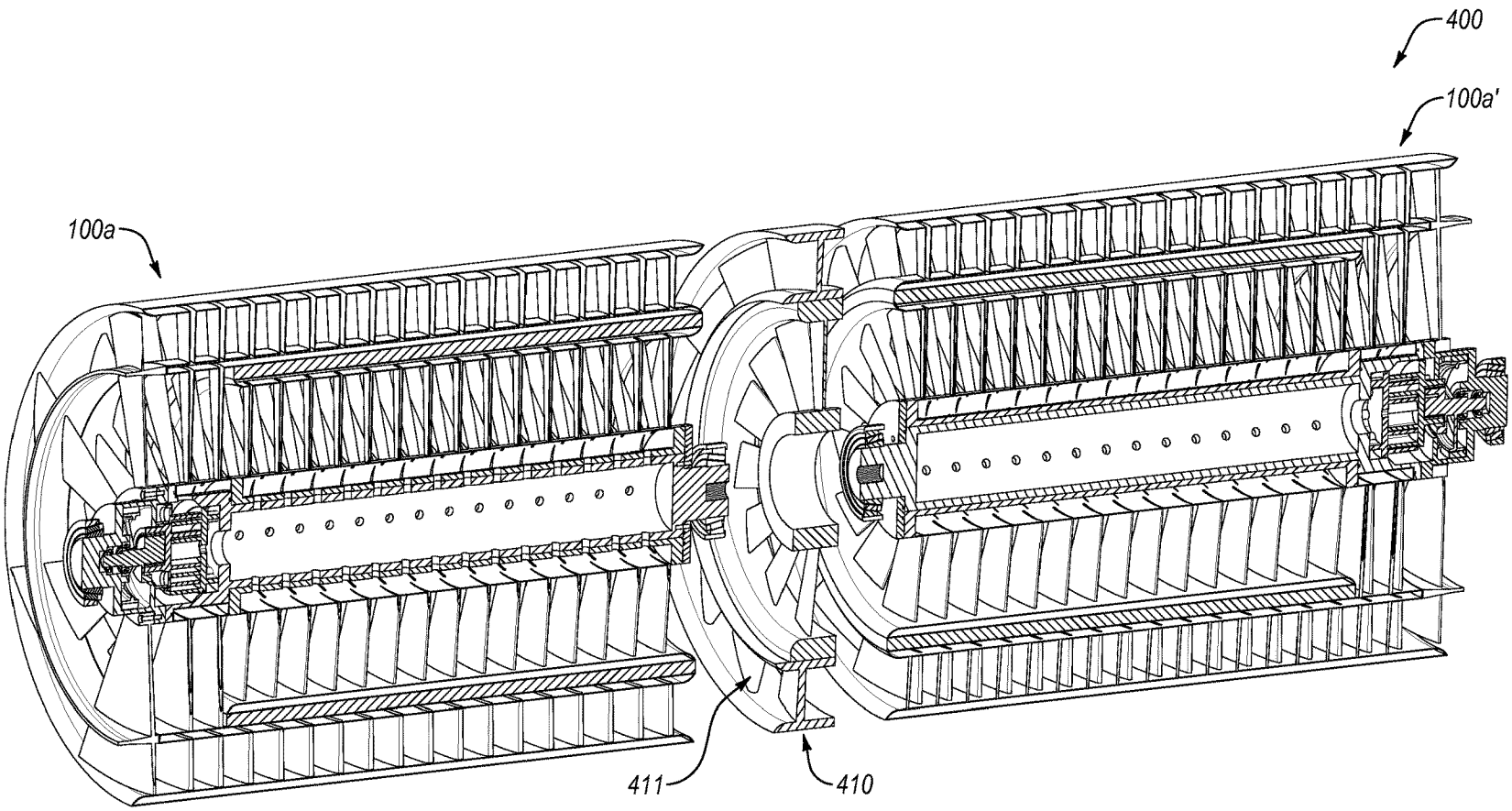
FIG. 10B is an isometric, cutaway view of a heat pump according to at least one embodiment.

Generally, the compressor 140*a* may be located at any suitable location or end of the core channel 104*a*. Hence, the refrigerant may have any number of suitable circulation paths and patterns through the heat pump 100*a*. Moreover, a system may include multiple heat pumps. FIG. 10B illustrates a heat exchange system 400 that includes a first heat pump 100*a* and a second heat pump 100*a*'. For instance, the first and second heat pumps 100*a*, 100*a*' may be positioned in series with each other, such that cold-side and/or hot-side medium may sequentially pass through the first and second heat pumps 100*a*, 100*a*'.

Under some operating conditions, as the medium (cold-side or hot-side) passes through corresponding heat exchangers, the medium may develop angular velocity. For example, depending on the length of the heat exchanger, speed of rotation, type of medium, etc., the medium may have the same or similar angular velocity as the rotating heat exchanger. As such, the relative velocity between the blades of the heat exchange and the medium may be reduced, thereby decreasing heat transfer therebetween.

In at least one embodiment, the heat exchange system 400 may include a stator 410 that may remove some or all of the angular movement from the medium passing therethrough. For example, the stator 410 may be located between the first and second heat pumps 100*a*, 100*a*' (e.g., the stator 410 may be located downstream from the first heat pump 100*a* and before the second heat pump 100*a*'). In an embodiment, the stator 410 may include one or more blades 411 that may be oriented in a manner that may remove angular velocity from the medium as the medium passes through the stator 410, before entering the second heat pump 100*a*'. In other embodiments, a stator may be placed within a single heat pump to reduce the angular velocity of the medium.

For instance, the blades 411 of the stator 410 may have a twist in a direction opposite to the direction of rotation of the first heat pump 100*a*, such that the medium exiting the first pump 100*a* and having an angular velocity in the direction of rotation of the heat pump 100*a* may straighten out its flow after passing through the stator 400. Moreover, in some embodiments, the stator 400 may be substantially stationary relative to a stationary component (e.g., base) of the first and/or second heat pumps 100*a*, 100*a*'. In other embodiments, successive rows of blades may use a different number of blades and/or a different pitch angle. For example, if successive rows of blades have substantially different exit-flow swirl distributions, then to some extent the swirl problem (or minimum relative motion between the air and the nth blade) may be mitigated.

Generally, medium may enter and exit the hot-side heat exchanger 120*a* and cold-side heat exchanger 130*a* (as well as hot-side heat exchanger 120 and cold-side heat exchanger 130 (FIGS. 1A-2D)) along or parallel to the rotation axes thereof. In some embodiments, as shown in FIGS. 11A-11B, the medium may enter a heat exchanger 120*b*, such as a hot-side and/or cold-side heat exchanger, from a center location and may exit such heat exchanger from an outer periphery thereof, as the heat exchanger rotates about rotation axis 30*b*'.

Figure 11A:
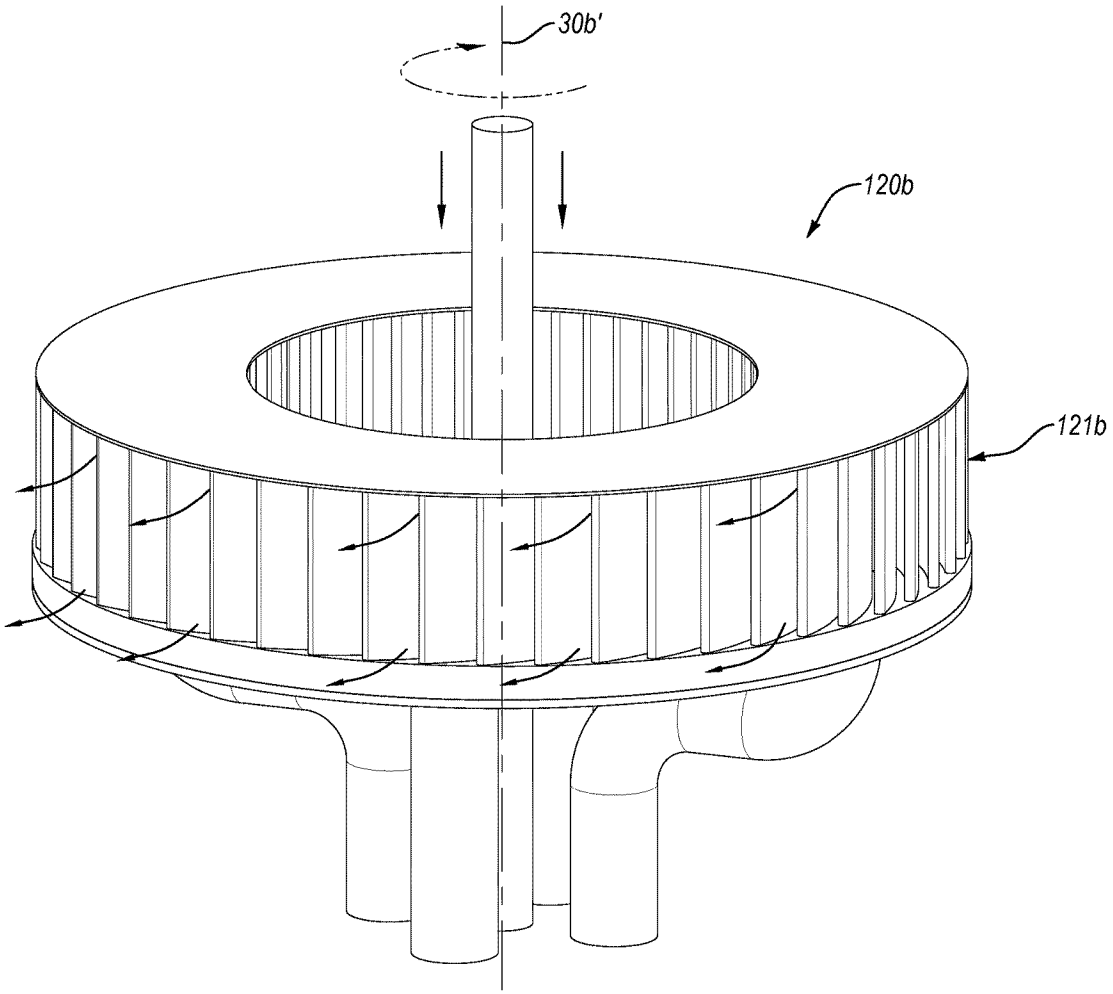
FIG. 11A is an isometric view of a heat exchanger according to an embodiment.

As shown in FIG. 11A, medium may enter the heat exchanger 120*b* from a center location and may exit at an outer periphery of the heat exchanger 120*b*. For example, the heat exchanger 120*b* may include blades 121*b*, which collectively may form an impeller configured to draw in the medium at the center and expel the medium from the outer periphery thereof. In some embodiments, the blades 121*b* may have additional or alternative configurations (i.e., non-impeller-like configurations); hence, for example, a fan or blower may force the medium through the heat exchanger 120*b* to exchange heat between the medium and the refrigerant in the heat exchanger 120*b*.

Figure 11B:
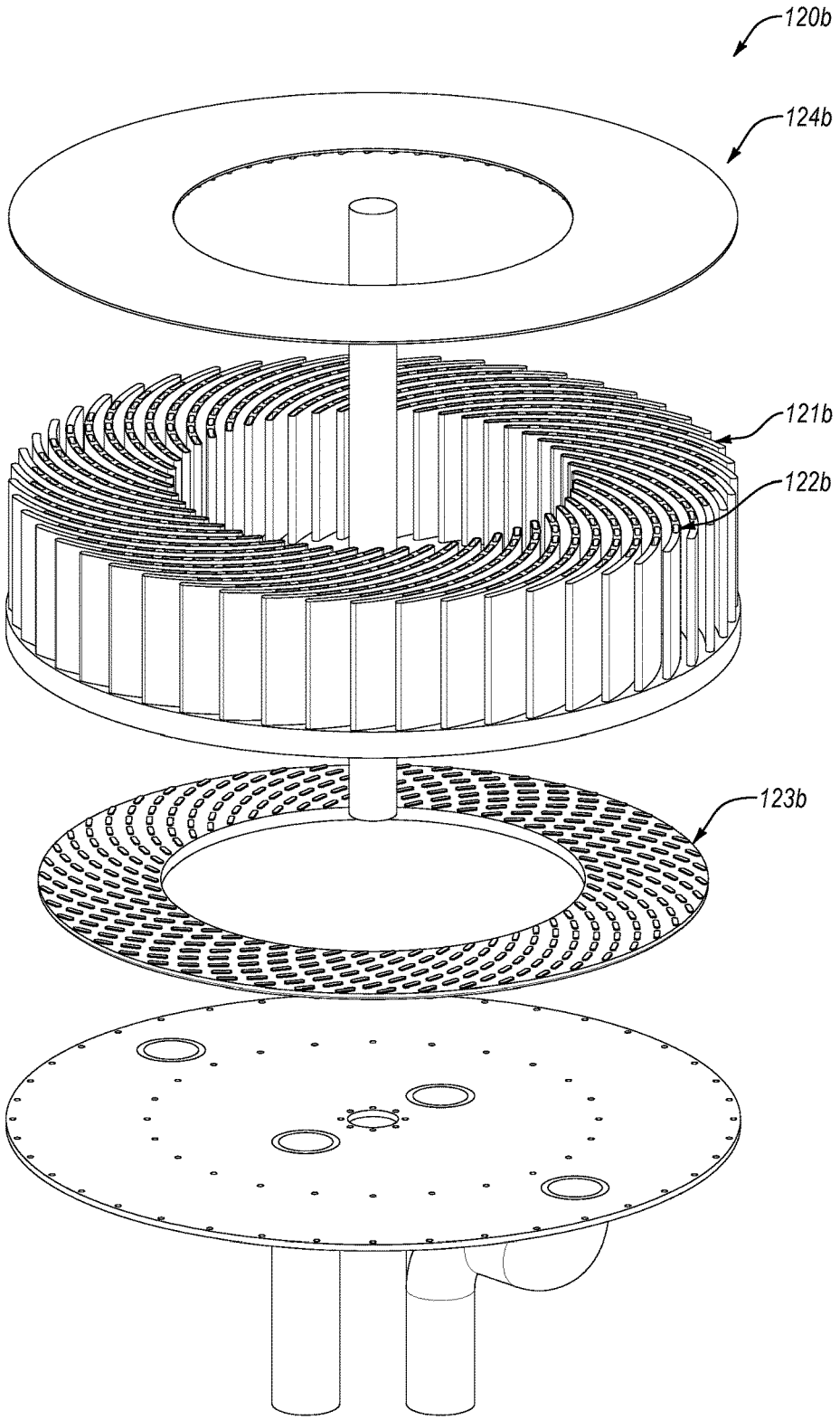
FIG. 11B is an isometric, exploded view of the heat exchanger of FIG. 11A.

As shown in FIG. 11B, the blades 121*b* may include one or more channels 122*b* that may extend into the blades 121*b*. Moreover, top and bottom plates 123*b*, 124*b* of the heat exchanger 120*b* may include one or more channels or grooves that, together with the channels 122*b*, may form serpentine channels within which the refrigerant may flow inside the blades 121*b*. Hence, for example, when the heat exchanger 120*b* is a hot-side heat exchanger, the refrigerant may enter the blades 121*b* and may condense therein forming liquid-phase refrigerant (e.g., the liquid-phase refrigerant may flow downward toward the bottom plate 123*b* and separate from gas-phase refrigerant). Alternatively, when the heat exchanger 120*b* is a cold-side heat exchanger, liquid-phase refrigerant may enter the blades 121*b* and may evaporate therein, forming gas-phase refrigerant, which may separate from the liquid-phase refrigerant in a similar manner as described above. In any event, the heat exchanger 120*b* may rotate about the rotation axis 30*b*' and may facilitate heat exchange between the refrigerant and a medium on a cold side and/or hot side of the heat pump.

Figure 12:
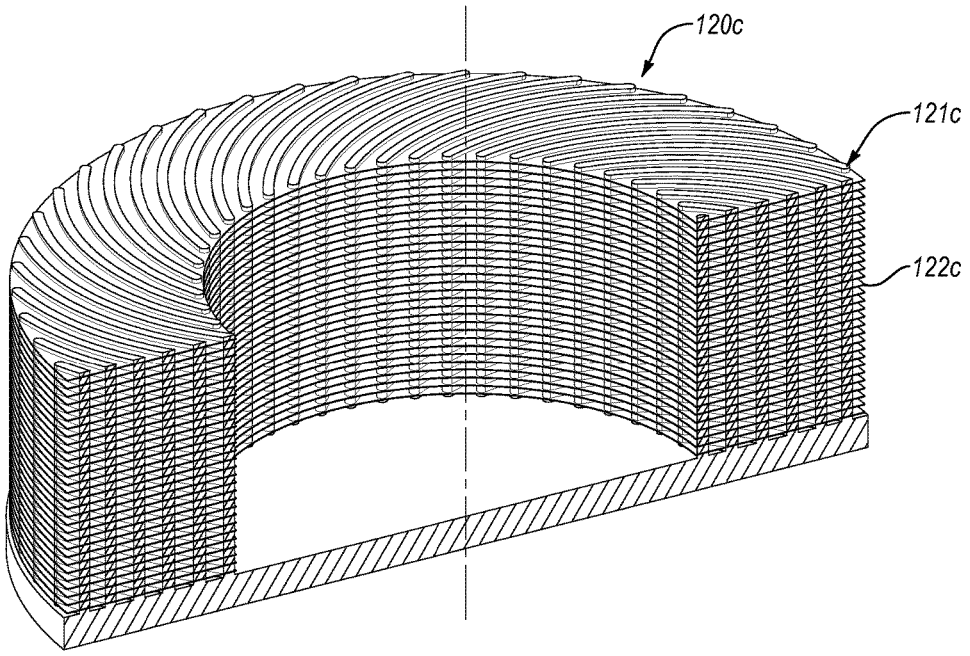
FIG. 12 is an isometric view of a portion of a heat exchanger according to an embodiment.

As mentioned above, in some instances, the blades may include and/or may be interconnected by one or more fins. FIG. 12 illustrates a heat exchanger 120*c* that includes blades 121*c* and one or more fins 122*c* that may extend from and/or between the blades 121*c*, according to an embodiment. For example, the fins 122*c* may interconnect some or all of the blades 121*c*. Moreover, the fins 122*c* may extend outward from the blades 121*c*, such that at least some of the fins 122*c* have at least one open or unconnected side.

Figure 13A:
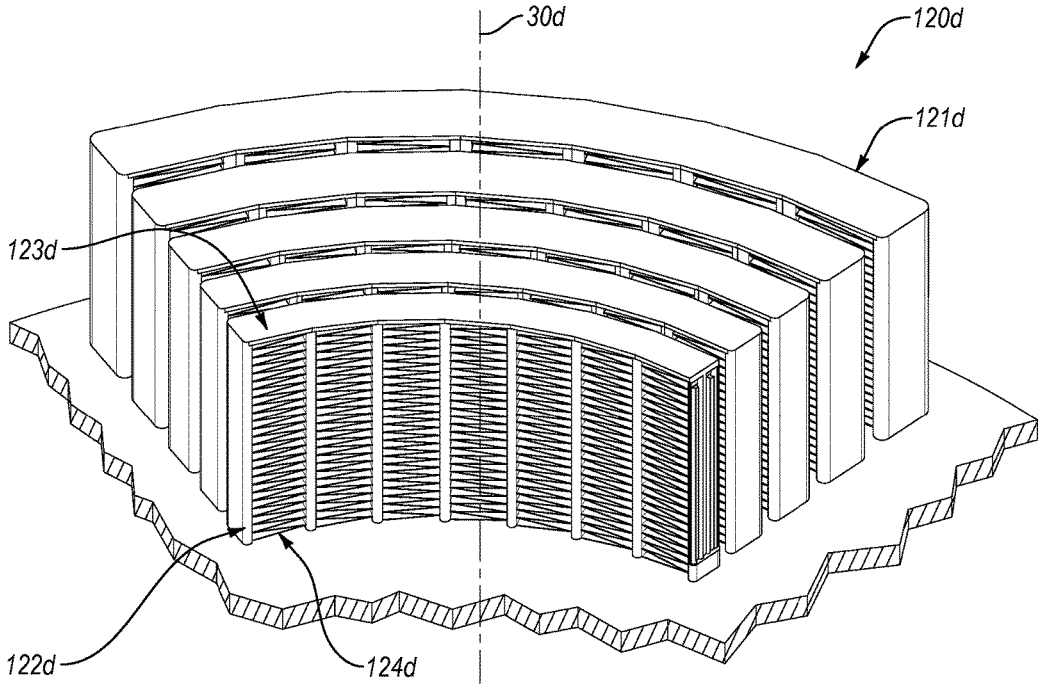
FIG. 13A is an isometric view of a portion of a heat exchanger according to another embodiment.
Figure 13B:
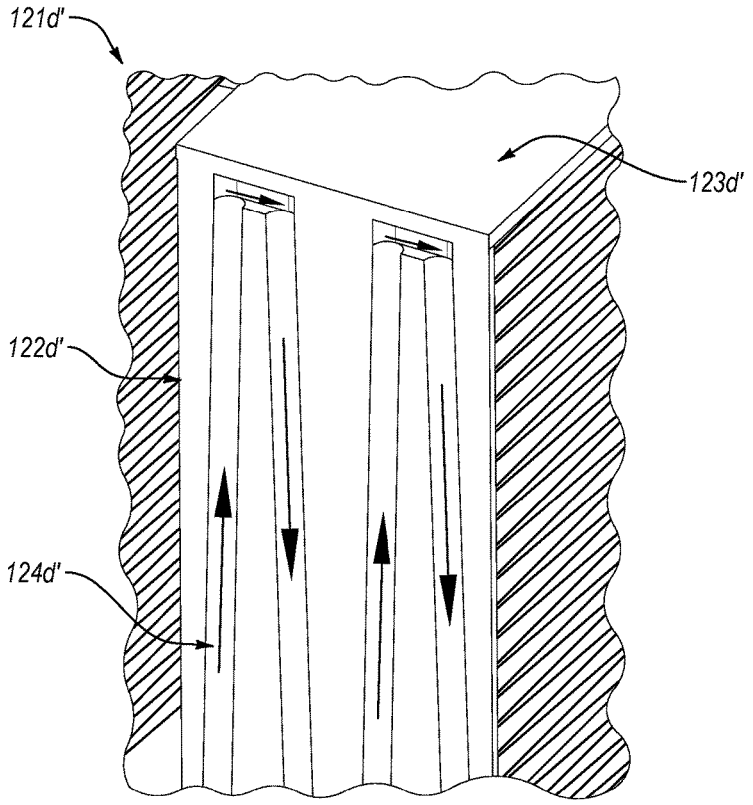
FIG. 13B is an isometric, cutaway view of portions of blades of a heat exchanger according to an embodiment.
Figure 13C:
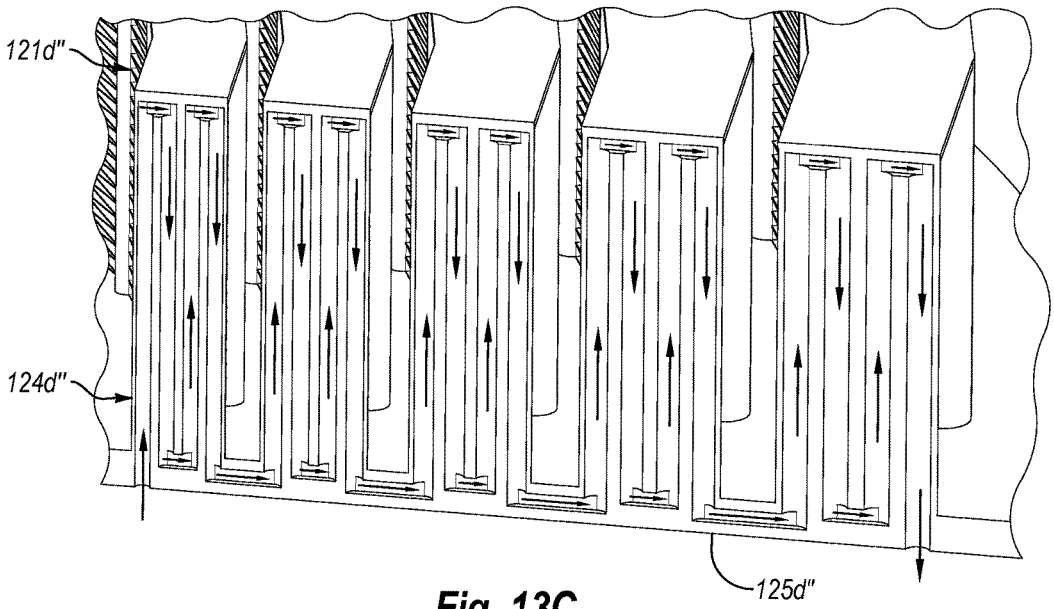
FIG. 13C is an isometric, cutaway view of a portion of a blade of a heat exchanger according to another embodiment.

In at least one embodiment, as shown in FIGS. 13A-13C, the blades may have a non-impeller-like configuration and/or may include multiple channels therein. In particular, FIG. 13A, for example, illustrates a heat exchanger 120*d* that include blades 121*d* concentrically positioned about rotation axis 30*d*. Additionally, the blades 121*d* may include vertical portions 122*d* and horizontal portions 123*d* connected with the vertical portions. In an embodiment, the heat exchanger 120*d* may include one or more fins 124*d* that may extend from the vertical portions 122*d*. The fins 124*d* may interconnect at least some of the vertical portions 122*d*. For example, the fins 124*d* may have zigzag pattern or configuration between adjacent vertical portions 122*d*.

In some embodiments, as shown in FIG. 13B, vertical portion 122*d*' and horizontal portion 123*d*' may include a portion of channel 124*d*', which collectively may form the channel 124*d*' in blades 121*d*' for the refrigerant. For instance, the vertical portion 122*d*' may include vertical portions of the channel 124*d*' and the horizontal portion 123*d*' may include horizontal portions of the channels 124*d*', which together with the vertical portions may form or define continuous channels 124*d*'. Additionally or alternatively, the vertical portion 121*d*' of the blades 121*d*' may contain all portions of or the entire channel(s)—i.e., the vertical portions 122*d*' may contain a complete or entire channel.

In at least one embodiment, the channel 124*d*' may route the refrigerant in multiple cycles or undulations through the blade 121*d*', such that the refrigerant is forced to change directions more than two times. Additionally or alternatively, as shown in FIG. 13C, channels 124*d*" in two or more of blades 121*d*" may be interconnected to form a continuous channel that may pass through multiple blades. Hence, the refrigerant may continuously flow through multiple blades 121*d*" (as indicated by the arrows) and may exchange heat through the blades 121*d*" with the medium passing about the blades 121*d*".

In an embodiment, the channel 124*d*" may include multiple undulations, such that the refrigerant may flow in two or more directions in at least some of the blades 121*d*". Also, in some examples, multiple blades 121*d*" also may be connected together and/or attached to a common base 125*d*". It should be appreciated that any of the channel configurations described herein may be included in any of the blades described herein.

Figure 14A:
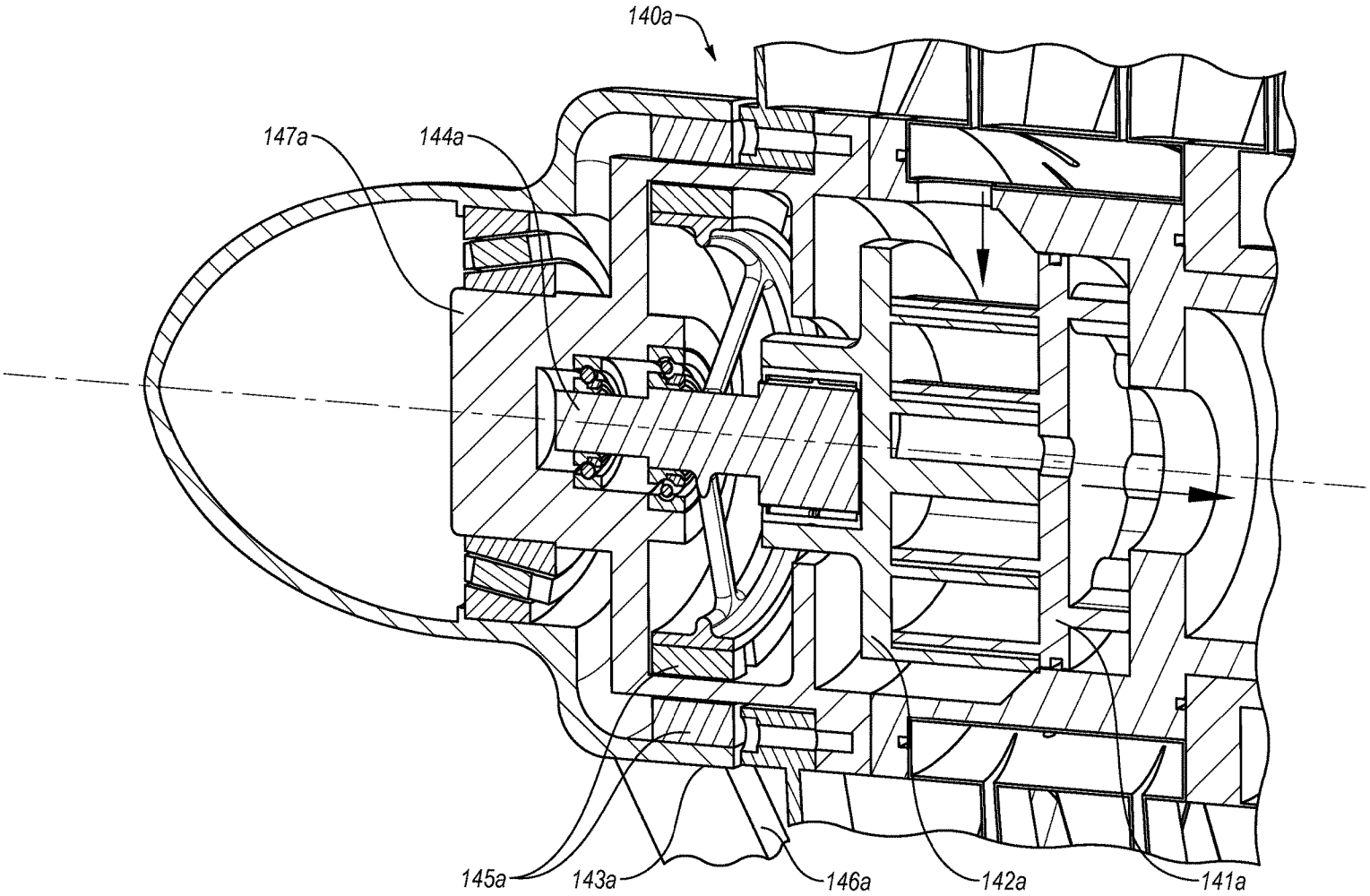
FIG. 14A is an isometric, cutaway view of a portion of a compressor according to still one other embodiment.

In any event, the refrigerant may enter the channels of the blades in the hot-side heat exchanger after being compressed by a compressor, and, after exiting the channels of the blades of the cold-side heat exchanger, may be channeled back to the compressor. Generally, the heat pump may include any suitable compressor, which may vary from one embodiment to the next. Typical compressors compress fluids through the relative movement of the compressor components (e.g., relative movement in the piston/cylinder, scroll/scroll, screw(s)/housing, rotor/housing combinations for reciprocating, scroll, screw and rotary motion (rotary vane, rolling piston, Wankel rotary) compressors, respectively), where the relative movement is driven by a shaft (straight shaft, crankshaft or eccentric shaft depending on the motion required). In an embodiment, the refrigerant may be compressed by maintaining a difference in angular velocity between the compressor shaft and the remainder of the compressor. For example, the heat pump may include a scroll compressor. FIG. 14A illustrates a scroll compressor 140*a* according to an embodiment, and includes an orbital scroll 142*a*, driven by an eccentric shaft 144*a*, and a non-orbital scroll 141*a*, where the orbital scroll undergoes orbital motion relative to the non-orbital scroll to compress the refrigerant. In an embodiment, relative orbital motion of the two scrolls and therefore compression may take place by maintaining a rotation speed difference between the eccentric shaft 144*a* connected to the orbital scroll 142*a* and the non-orbital scroll 141*a*.

In an embodiment, a portion of the compressor may be attached or connected to a support or a stand supporting the heat pump and/or one or more portions thereof. FIG. 14A illustrates a compressor 140*a* according to one or more embodiments, which includes a heat pump mount 143*a* connected to a support 146*a*. For example, the support 146*a* may support a first end of the heat pump (e.g., the support 146*a* may support a first end of the heat pump 100*a* (FIG. 10A)). In at least one embodiment, the support 146*a* and the mount 143*a* may remain stationary to a structure or a support surface securing the heat pump.

Furthermore, the compressor 140*a* may include a rotatable housing 147*a*, which may rotate together with one or more heat exchangers of the heat pump. For example, the rotatable housing may be connected to the cold-side and/or hot-side heat exchangers of the heat pump. Hence, the rotatable housing 147*a* may rotate together with the at least one heat exchanger of the heat pump relative to the support 146*a*. In some instances, the rotatable housing 147*a* may rotate together with a non-orbital scroll 141*a*, in a manner that the non-orbital scroll 141*a* moves relative to the orbital scroll 142*a*. In some examples, the refrigerant may be fully contained within the rotatable housing 147*a* and may rotate together therewith.

In an embodiment, the rotatable housing 147*a* may be coupled or rotatably connected to the mount 143*a*. For example, one or more bearings (e.g., tapered roller bearings, radial bearings, thrust bearings, etc.) may rotatably support the rotatable housing 147*a* inside the mount 143*a*. As mentioned above, the mount 143*a* may be supported by at least one support 146*a*.

In an embodiment, the orbital scroll 142*a* may be actuated by an eccentric shaft 144*a*. The eccentric shaft 144*a* may be rotatably connected to the rotatable housing 147*a*. For instance, the compressor 140*a* may include one or more bearings that may rotatably secure the eccentric shaft 144*a* and the orbital scroll 142*a* to the rotatable housing 147*a*. As such, the rotatable housing 147*a* may rotate relative to the eccentric shaft 144*a* and the orbital scroll 142*a*.

As described above, in some embodiments, the orbital scroll 142*a* may maintain an orbital motion relative to at least a portion of the compressor 140*a*. In an embodiment, this orbital motion may be generated by maintaining the eccentric shaft 144*a* stationary relative to the mount 143*a*, while the non-orbital scroll 141*a* is connected to and rotates with the rotating portions of the heat pump (e.g., the rotating hot-side and/or cold-side heat exchangers). Hence, relative orbital movement of the non-orbital scroll 141*a* and orbital scroll 142*a* may compress the refrigerant inside the compressor 140*a* and produce refrigerant flow as indicated with the arrows. In other embodiments, the orbital motion of the orbital scroll 142*a* may be generated by rotating the eccentric shaft 144*a* at a different speed than the non-orbital scroll 141*a* to compress the refrigerant. In such embodiment, the mount 147*a* may rotate with the eccentric shaft 144*a*, and may not be connected to the support 146*a*.

In an embodiment, the eccentric shaft 144*a* connected to the orbital scroll 142*a* may be connected to the mount 143*a* by magnetic pairs 145*a* (e.g., a pair of magnets in attraction with each other, which may have respective N and S poles facing each other). More specifically, for instance, first magnetic portions may be attached to the mount 143*a* and second magnetic portions may be attached to a section of the eccentric shaft 144*a*. The first and second magnetic portions may exhibit magnetic attraction/repulsion to one another, such that the second magnetic portions and the eccentric shaft 144*a* remain substantially stationary relative to the mount 143*a* (i.e. the eccentric shaft 144*a* and the mount 143*a* have the same rotation speed). In such embodiment, use of magnetic coupling enables hermetic sealing of the compressor, by avoiding the use of shaft seals, which are needed when the compressor shaft is directly connected to a motor, mount 143*a*, support 146*a* or other stationary fixture. It should be appreciated that, in some embodiments, the orbital scroll 142*a* may exhibit some angular movement or rotation during operation of the compressor 140*a*. In any event, however, the non-orbital scroll 141*a* may have movement relative to the orbital scroll 142*a* during operation of the compressor 140*a*, thereby compressing the refrigerant therein.

In some embodiments, at least a portion of the housing 147*a* may comprise a low-electrical-conductivity material (e.g., carbon fiber, fiberglass, plastic, etc.). Also, in an embodiment, one or more "black-iron" elements may be used for flux guiding and to minimize reluctance of the magnetic circuit. In some instances, the N and S pairs that comprise the magnetic pair 145*f* may be alternating, such that each S pole magnet includes an adjacent N pole magnet facing in the same direction. In a further embodiment, a hermetic barrier between rotor and stator of a drive motor may be used to impart relative rotational motion without loss of hermeticity. For example, a non-rotating stator assembly may be used to generate a rotating magnetic field adapted to impart rotation to a rotor structure (e.g., a permanent magnet rotor or squirrel cage induction rotor) that is rigidly attached to one or more structures to which torque is to be transmitted.

Figure 14B:
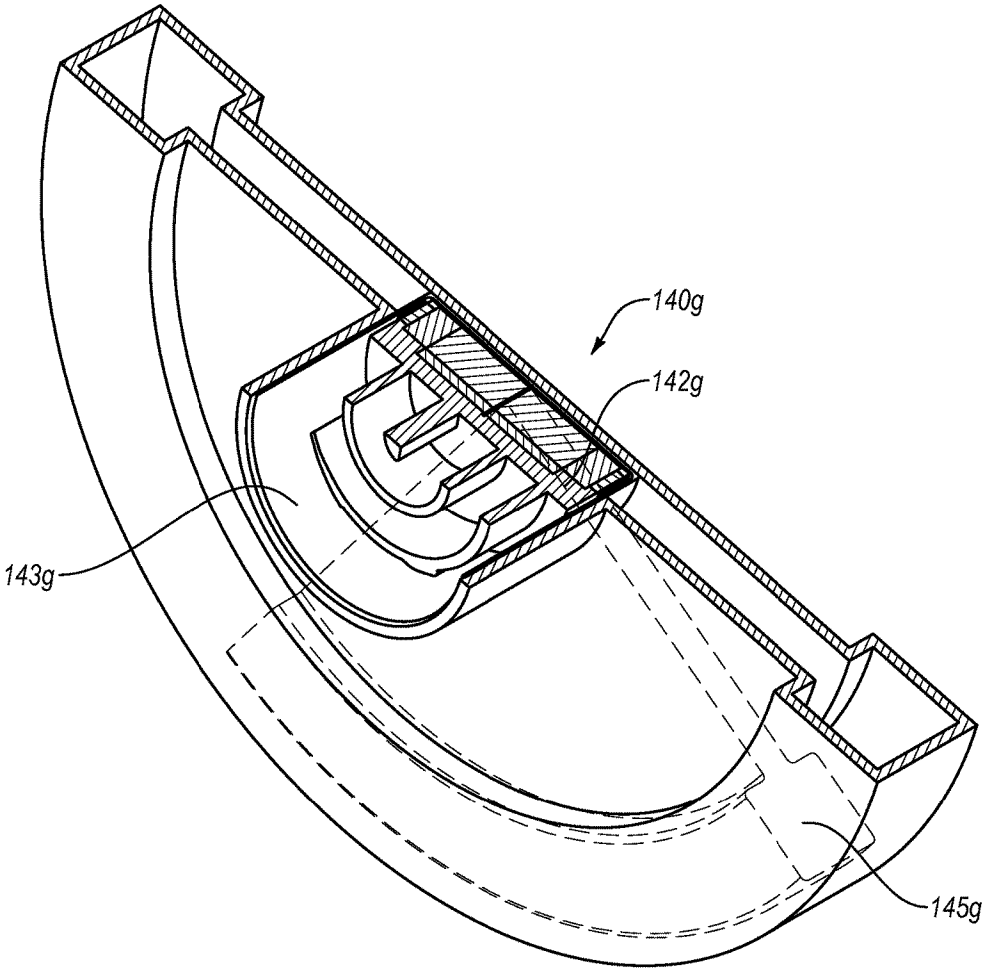
FIG. 14B is an isometric, cutaway view of a portion of a compressor according to another embodiment.

Alternatively, hermeticity may be maintained in the compressor 140*g*, as shown in FIG. 14B, by including a pendulum 145*g* that may be connected to the orbital scroll 142*g* of the compressor 140*g* (e.g., the pendulum 145*g* may be located inside a portion of a housing 143*g*). In such embodiment, the weight of the pendulum may hold the eccentric shaft connected to the orbital scroll 142*g* stationary. In any event, in some embodiments, rotation of the housing 143*g* of the compressor 140*g* together with the non-orbital scroll may produce relative movement of the orbital scroll 142*g* and the non-orbital scroll of the compressor 140*g*, thereby compressing the refrigerant.

It should be also appreciated that the compressor may have any suitable configuration. For example, a conventional compressor may be used in the heat pump that includes rotatable hot-side and/or cold-side heat exchangers. In an embodiment, a conventional compressor may include an electric motor coupled in a manner that permits rotation of the electric motor and the compressor relative to a stationary power supply. In other words, the compressor may be powered by a motor that may be independent of the motor rotating the hot-side and/or cold-side heat exchangers. Furthermore, in some embodiments, the heat pump and the compressor may form a sealed system that may have fewer or none of the mechanical or movable seals, which may be otherwise present in a conventional heat pump, thereby minimizing or eliminating leakage paths.

Figure 15:
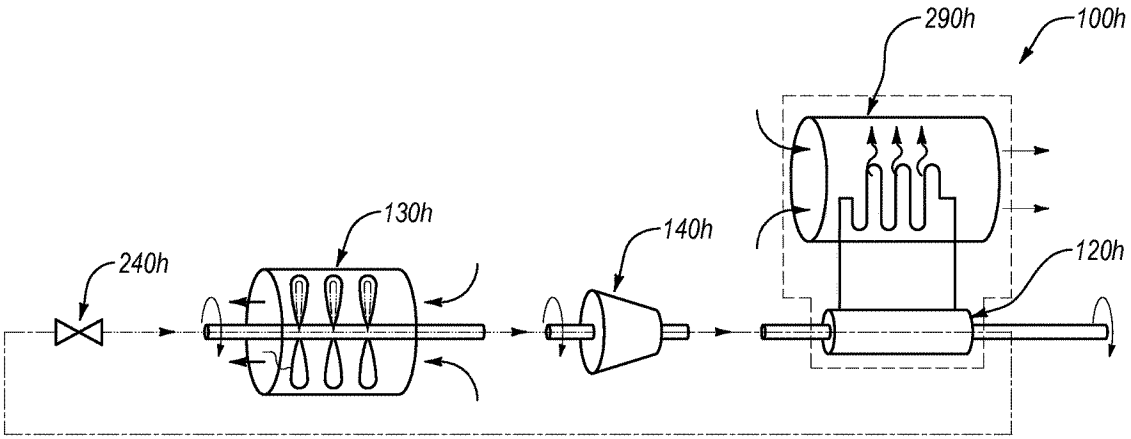
FIG. 15 is a diagrammatic view of a heat pump according to an embodiment.

As mentioned above, in some embodiments, the heat pump may include one or more heat exchangers that may be stationary. FIG. 15, for example, illustrates a heat pump 100*h* according to an embodiment. For example, the heat pump 100*h* may include a rotating hot-side heat exchanger 120*h*, cold-side heat exchanger 130*h*, expansion valve 240*h* and compressor 140*h*, and a stationary secondary heat exchanger 290*h*. More specifically, in at least one embodiment, the hot-side heat exchanger 120*h* may be in fluid communication with the secondary heat exchanger 290*h*, such that the secondary heat exchanger 290*h* may remain stationary. In some instances, a cooling fluid may circulated between the hot-side heat exchanger 120*h* and the secondary heat exchanger 290*h* and may cool and condense the refrigerant in the hot-side heat exchanger 120*h*.

Furthermore, the cooling fluid may be cooled in the secondary heat exchanger 290*h* (e.g., by passing ambient air through the secondary heat exchanger 290*h* and exchanging heat between the cooling fluid and ambient air, thereby reducing the temperature of the cooling fluid). In some embodiments, the secondary heat exchanger 290*h* may be a cooling tower. Also, in at least one embodiment, the hot-side heat exchanger 120*h* may be a tubular member or a conduit in thermal communication with the cooling fluid, such that the refrigerant passing through the hot-side heat exchanger 120*h* may condense therein. In any event, the condensed refrigerant may exit the hot-side heat exchanger 120*h* and, after expanding (e.g., after passing through an expansion valve 240*h*) may enter the cold-side heat exchanger 130*h*.

Figure 16:
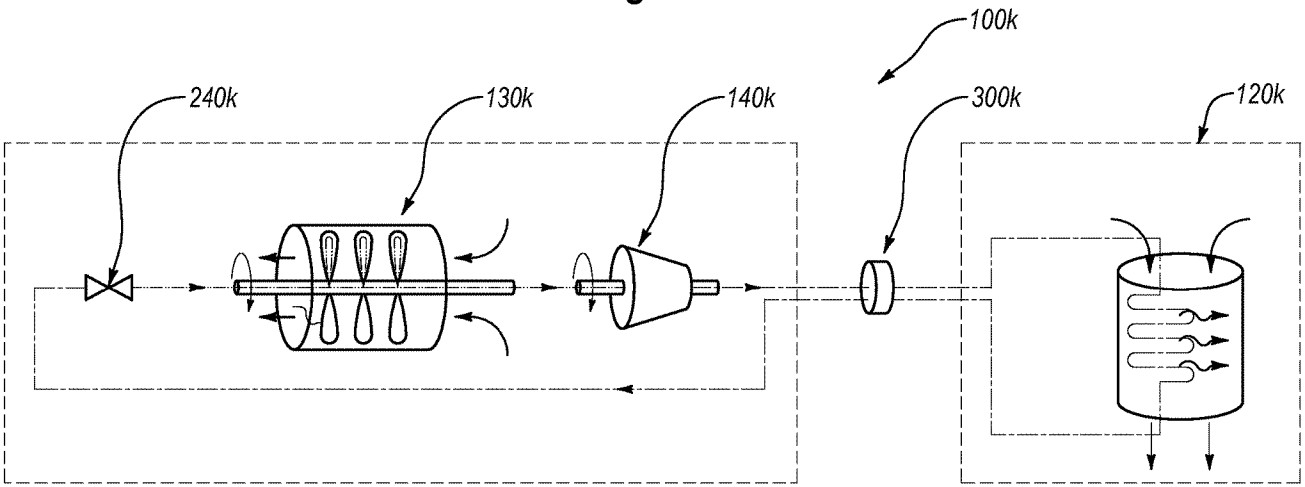
FIG. 16 is a diagrammatic view of a heat pump according to another embodiment.

In some embodiments, the condenser, or the hot-side heat exchanger, of the heat pump may remain stationary. For example, as illustrated in FIG. 16, a heat pump 100*k* may include a rotating cold-side heat exchanger 130*k*, expansion valve 240*k*, and compressor 140*k*, and a stationary hot-side heat exchanger 120*k*. For instance, the compressor 140*k* may be rotatably connected to the hot-side heat exchanger 120*k* through a rotary fluid coupling 300*k*, such that the compressor 140*k* may rotate together with the cold-side heat exchanger 130*k*, while the hot-side heat exchanger 120*k* remains stationary. Alternatively or additionally, the compressor and the hot-side heat exchanger may be stationary, and the cold-side heat exchanger may be rotatably connected to the hot-side heat exchanger (e.g., through a rotary fluid coupling). For example, the hot-side heat exchanger 120*k* may be a conventional non-rotating condenser. Similarly, a stationary compressor may be a conventional non-rotating compressor. Moreover, the compressed refrigerant exiting the hot-side heat exchanger 120*k* may flow through the rotary fluid coupling 300*k* and into the cold-side heat exchanger 130*k* (i.e., permitting the cold-side heat exchanger 130*k* to rotate relative to the hot-side heat exchanger 120*k*.

While embodiments in which elements of hot-side heat exchange may be stationary are described above, other embodiments may include elements of the cold-side heat exchange that are stationary. That is, the evaporator, or the cold-side heat exchanger may be in fluidic communication with a stationary heat exchanger. Alternatively, the cold-side heat exchanger, expansion valve, or compressor, and any combination of these components, may be stationary, with connection to the other rotating components accomplished by rotary fluid coupling(s).

While various aspects and embodiments have been disclosed herein, other aspects and embodiments are contemplated. The various aspects and embodiments disclosed herein are for purposes of illustration and are not intended to be limiting.

What is claimed is:

1. A heat pump, comprising:

a compressor configured to compress a refrigerant;

a hot-side heat exchanger comprising hot-side blades, each of the hot-side blades of the hot-side heat exchanger comprises one or more hot-side blade channels, the hot-side heat exchanger operably connected to the compressor and configured to receive the refrigerant from the compressor, the refrigerant received from the compressor being compressed, and the refrigerant received from the compressor flows through at least one of the one or more hot-side blade channels of at least one of the hot-side blades of the hot-side heat exchanger;

a pressure-reduction device connected to the hot-side heat exchanger and configured to receive the refrigerant from the hot-side heat exchanger;

a cold-side heat exchanger comprising cold-side blades, each of the cold-side blades of the cold-side heat exchanger comprises one or more cold-side blade channels, the cold-side heat exchanger operably connected to the pressure-reduction device and configured to receive the refrigerant from the pressure-reduction device, the refrigerant received from the pressure-reduction device flows through at least one of the one or more cold-side blade channels of at least one of the cold-side blades of the cold-side heat exchanger, the cold-side heat exchanger further comprises:

a first channel in fluid communication with the pressure-reduction device; and a second channel, the second channel being radially spaced farther from a rotation axis of the cold-side heat exchanger as compared to the first channel;

wherein at least a subset of the cold-side blades of the cold-side heat exchanger extend between the first channel and the second channel, and wherein one or more of the cold-side blade channels of the cold-side blades of the cold-side heat exchanger in the subset provide fluid communication between the first channel and the second channel; and wherein one or more of the hot-side heat exchanger or the cold-side heat exchanger is rotatable.

2. The heat pump of claim 1, further comprising a motor mounted on a motor mount and operably coupled to one or more of the hot-side heat exchanger or cold-side heat exchanger, the motor being configured to rotate the one or more of the hot-side heat exchanger or the cold-side heat exchanger relative to the motor mount.

3. The heat pump of claim 1, the hot-side heat exchanger further comprises:

a third channel in fluid communication with the compressor; and a fourth channel, the fourth channel being radially spaced farther from a rotation axis of the hot-side heat exchanger as compared to the third channel;

wherein a first subset of the hot-side blades of the hot-side heat exchanger extend between the third channel and the fourth channel, and wherein the one or more hot-side blade channels of the hot-side blades of the hot-side heat exchanger in the first subset provide fluid communication between the third channel and the fourth channel.

4. The heat pump of claim 3, wherein each of the hot-side blades in the first subset is configured to separate liquid-phase refrigerant from gas-phase refrigerant during rotation of the hot-side heat exchanger.

5. The heat pump of claim 3, wherein the hot-side heat exchanger includes a fifth channel in fluid communication with the fourth channel, the fifth channel being configured and arranged to supply condensed refrigerant into the pressure-reduction device, toward the cold-side heat exchanger.

6. The heat pump of claim 5, wherein a second subset of the hot-side blades of the hot-side heat exchanger extend between the fourth channel and the fifth channel, and wherein the one or more hot-side blade channels of the hot-side blades of the hot-side heat exchanger in the second subset provide fluid communication between the fourth channel and the fifth channel.

7. The heat pump of claim 1, wherein the rotation axis of the cold-side heat exchanger is generally coaxial with a rotation axis of the hot-side heat exchanger.

8. The heat pump of claim 1, wherein the cold-side heat exchanger and the hot-side heat exchanger are longitudinally spaced from each other.

9. The heat pump of claim 1, wherein the cold-side heat exchanger and the hot-side heat exchanger are concentrically located relative to each other.

10. The heat pump of claim 1, wherein at least a portion of the compressor is rotatable together with one or more of the hot-side heat exchanger or the cold-side heat exchanger.

11. The heat pump of claim 1, wherein the one or more hot-side blade channels of the hot-side blades of the hot-side heat exchanger extend radially relative to a rotation axis of the hot-side heat exchanger, and wherein the one or more cold-side blade channels of the cold-side blades of the cold-side heat exchanger extend radially relative to a rotation axis of the cold-side heat exchanger.

12. The heat pump of claim 1, the first channel and the second channel being cylindrical channels.

13. A heat pump, comprising:

a compressor configured to compress a refrigerant;

a hot-side heat exchanger including hot-side blades each having one or more hot-side blade channels, the hot-side heat exchanger being operably connected to the compressor and configured to receive the refrigerant from the compressor in at least some of the one or more hot-side blade channels of the hot-side blades;

a cold-side heat exchanger including cold-side blades each having one or more cold-side blade channels, the cold-side heat exchanger being operably connected to the hot-side heat exchanger and configured to receive the refrigerant from the hot-side heat exchanger in at least some of the one or more cold-side blade channels of the cold-side blades, the cold-side heat exchanger further comprises:

a first channel in fluid communication with the hot-side heat exchanger; and a second channel, the second channel being radially spaced farther from a rotation axis of the cold-side heat exchanger as compared to the first channel;

wherein at least a subset of the cold-side blades of the cold-side heat exchanger extend between the first channel and the second channel, and wherein one or more of the cold-side blade channels of the cold-side blades of the cold-side heat exchanger in the subset provide fluid communication between the first channel and the second channel; and wherein one or more of the hot-side heat exchanger or the cold-side heat exchanger is rotatable.

14. The heat pump of claim 13, further comprising a pressure-reduction device configured to receive the refrigerant from the hot-side heat exchanger and to reduce the pressure and temperature of the refrigerant, and wherein the cold-side heat exchanger is operably connected to the hot-side heat exchanger through the pressure-reduction device and configured to receive the refrigerant through the pressure-reduction device in the at least some of the one or more cold-side blade channels of the cold-side blades.

15. The heat pump of claim 14, wherein the pressure-reduction device includes one or more expansion valves.

16. A heat pump, comprising:

a compressor configured to compress a refrigerant;

a hot-side heat exchanger including hot-side blades each having one or more hot-side blade channels, the hot-side heat exchanger being operably connected to the compressor and configured to receive the refrigerant from the compressor in at least some of the one or more hot-side blade channels of the hot-side blades, the hot-side heat exchanger further comprises:

a first cylindrical channel in fluid communication with the compressor;

a second cylindrical channel, the second cylindrical channel being radially spaced farther from a rotation axis of the hot-side heat exchanger as compared to the first channel;

wherein a first subset of the hot-side blades of the hot-side heat exchanger extend between the first cylindrical channel and the second cylindrical channel, and wherein the one or more hot-side blade channels of the hot-side blades of the hot-side heat exchanger in the first subset provide fluid communication between the first cylindrical channel and the second cylindrical channel; and;

a cold-side heat exchanger including cold-side blades each having one or more cold-side blade channels, the cold-side heat exchanger being operably connected to the hot-side heat exchanger and configured to receive the refrigerant from the hot-side heat exchanger in at least some of the one or more cold-side blade channels of the cold-side blades; and wherein one or more of the hot-side heat exchanger or the cold-side heat exchanger is rotatable.

17. The heat pump of claim 16, further comprising a pressure-reduction device configured to receive the refrigerant from the hot-side heat exchanger and to reduce the pressure and temperature of the refrigerant, and wherein the cold-side heat exchanger is operably connected to the hot-side heat exchanger through the pressure-reduction device and configured to receive the refrigerant through the pressure-reduction device in the at least some of the one or more cold-side blade channels of the cold-side blades.

18. The heat pump of claim 14, wherein each of the hot-side blades in the first subset is configured to separate liquid-phase refrigerant from gas-phase refrigerant during rotation of the hot-side heat exchanger.

19. The heat pump of claim 14, further comprising a motor mounted on a motor mount and operably coupled to one or more of the hot-side heat exchanger or cold-side heat exchanger, the motor being configured to rotate the one or more of the hot-side heat exchanger or the cold-side heat exchanger relative to the motor mount.

20. The heat pump of claim 14, wherein a rotation axis of the cold-side heat exchanger is generally coaxial with the rotation axis of the hot-side heat exchanger.

21. The heat pump of claim 14, wherein the cold-side heat exchanger and the hot-side heat exchanger are longitudinally spaced from each other.

22. The heat pump of claim 14, wherein the cold-side heat exchanger and the hot-side heat exchanger are concentrically located relative to each other.

23. The heat pump of claim 14, wherein at least a portion of the compressor is rotatable together with one or more of the hot-side heat exchanger or the cold-side heat exchanger.

24. The heat pump of claim 14, the cold-side heat exchanger further comprises:

a third cylindrical channel in fluid communication with the hot-side heat exchanger; and a fourth cylindrical channel, the fourth cylindrical channel being radially spaced farther from a rotation axis of the cold-side heat exchanger as compared to the third cylindrical channel;

wherein at least a subset of the cold-side blades of the cold-side heat exchanger extend between the third channel and the fourth channel, and wherein one or more of the cold-side blade channels of the cold-side blades of the cold-side heat exchanger in the subset provide fluid communication between the third cylindrical channel and the fourth cylindrical channel.

* * * * *